United States Patent [19]

Hodgson et al.

[11] 4,403,208

[45] Sep. 6, 1983

[54] WARNING-SIGNAL-PRODUCING SYSTEM FOR A MOTOR VEHICLE RESPONSIVE TO A VEHICLE-PRESENCE-INDICATING RADIO WAVE SIGNAL EMITTED BY ANOTHER VEHICLE AND INDICATIVE OF ITS PRESENCE

[76] Inventors: R. W. Hodgson, 1680 N. Vine St., No. 204, Hollywood, Calif. 90028; Frank L. Dahl, 5248 W. 119th Pl., Inglewood, Calif. 90304

[21] Appl. No.: 29,738

[22] Filed: Apr. 13, 1979

Related U.S. Application Data

[63] Continuation-in-part of Ser. No. 624,875, Oct. 23, 1975, abandoned.

[51] Int. Cl.[3] ..... G08G 1/00

[52] U.S. Cl. ..... 340/33; 455/99; 455/152; 455/228; 455/345

[58] Field of Search ..... 340/32–34; 455/95, 99, 98, 110, 134, 140, 152, 254, 205, 228, 238, 297, 308, 345, 355, 66, 54, 57

[56] References Cited

U.S. PATENT DOCUMENTS

| | | | |
|---|---|---|---|
| 3,257,641 | 6/1966 | Campana et al. | 340/32 |
| 3,293,600 | 12/1966 | Gifft | 340/33 |
| 3,584,304 | 6/1971 | Casterline et al. | 340/694 |
| 3,662,328 | 5/1972 | Spivak | 340/33 |
| 3,784,970 | 1/1974 | Simpkin | 340/33 |
| 3,876,940 | 4/1975 | Wickford et al. | 340/33 |
| 3,921,074 | 11/1975 | Baird | 340/32 |
| 4,006,447 | 2/1977 | Narbaits-Jaureguy et al. | 340/33 |

*Primary Examiner*—James J. Groody

[57] ABSTRACT

Warning-signal producing apparatus and system for a first motor vehicle responsive to a vehicle-presence-indicating radio wave signal produced by and emitted from a second motor vehicle within a certain distance of the first motor vehicle for effectively causing the production of a corresponding warning signal within the interior of the first motor vehicle and, in one form, for correspondingly attenuating, muting, or interrupting sound emitted by any simultaneously operating intertainment apparatus within the first-mentioned-motor vehicle. In one form, the second motor vehicle (often an emergency vehicle) is provided with a radio frequency transmitter adapted to produce and transmit a vehicle-presence-indicating radio frequency signal, and each other vehicle (such as the first vehicle mentioned above) which is intended to be warned of the presence of the second vehicle, is provided with radio-frequency-signal-receiving apparatus effectively tuned so as to receive the vehicle-presence-indicating signal transmitted from the second vehicle, and is further provided with apparatus responsive thereto for effectively causing the production of some type of perceptible warning signal to alert an occupant of the first motor vehicle of the nearby presence of the second motor vehicle. Both the transmitter and the receiver, in a preferred form, are provided with effectively distance-calibrated signal limiting or gate apparatus cooperable with each other to provide for the reception by the first vehicle of the signal transmitted by the second vehicle only at or less than a precisely calibrated desired distance.

5 Claims, 12 Drawing Figures

A.C. Gen.
Battery
Volt Reg.
132
137
136
134
130
Motor Vehicle Electrical System
140
Rectifier
Power Supply
P
INPUT
124
128
144
140
60
Filter
148
Starter
146
126
P
124
142
124
P
Warning Signal
78
59
Sensitivity Control
Ignition System
Ent. Output Stage
104
Sound Producer
96
Detector
100
106
106'
Circuit Interrupter
80
98
94
122
44
+12V
90
118
66
116
86
120
88
122'
92
120'
44'
114
82
Speakers
102
84
92
92
64
66
79
Switch Control
Switch
Sound Muter

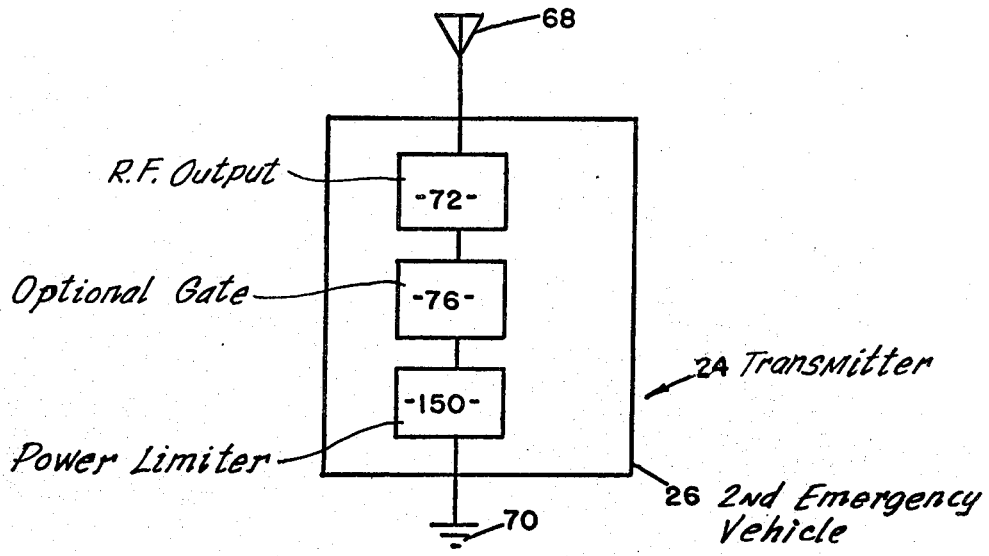
FIG. 3
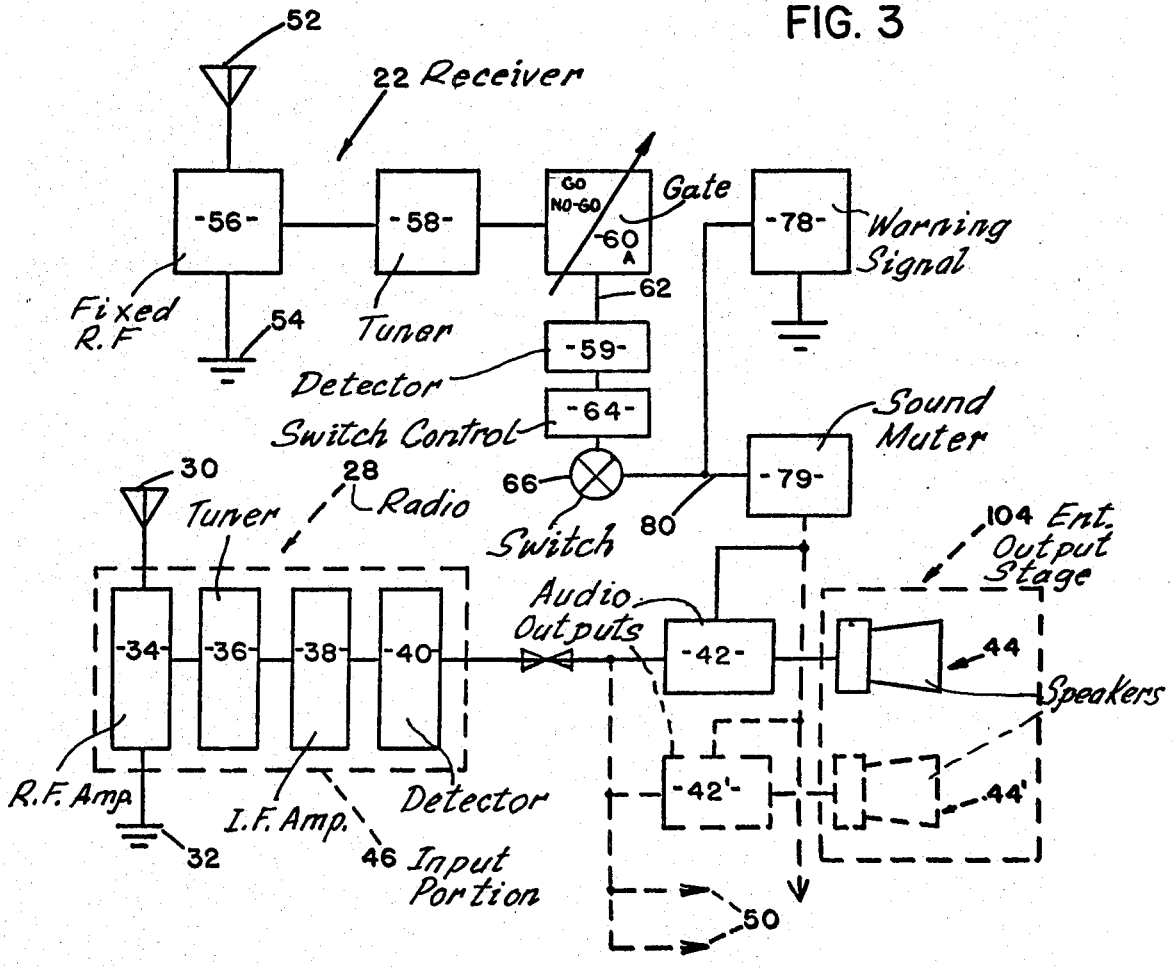

Freq. Response Means
154C
152C
156C
80C
162C
164C
Receiver
22
52
Fixed R.F.
Tuner
Sensitivity Control
56
58
60
59
64
Switch Control
Detector
62
Power Supply
54
124
66 Switch
166
128
126
Filter
168
100C
Circuit Interrupter
Sound Muter
30
169
Tuner
Radio
28
79C
104
Ent. Output Stage
34
36
38
40
42
44
Audio Outputs
42'
44'
Detector
32
46 Input Portion
R.F. Amp.
I.F. Amp.
50
Speakers

WARNING-SIGNAL-PRODUCING SYSTEM FOR A MOTOR VEHICLE RESPONSIVE TO A VEHICLE-PRESENCE-INDICATING RADIO WAVE SIGNAL EMITTED BY ANOTHER VEHICLE AND INDICATIVE OF ITS PRESENCE

CROSS REFERENCE TO RELATED APPLICATION

This apparatus is a continuation-in-part application of prior copending application, Ser. No. 624,875 filed Oct. 23, 1975, now abandoned, and having a similar title.

BACKGROUND OF THE INVENTION

The field of the invention is generally that of alarm apparatuses or warning devices or equipment capable of indicating the presence of some predetermined condition or object so that a person's attention, which might otherwise be occupied with other matters, will be immediately alerted to the presence of said condition or object for use in a decision-making process as to what action, if any, the person will take, based upon his recognition of the presence of the condition or object. More particularly, the present invention pertains to apparatus intended to solve the prior art problem of providing to the driver of a first vehicle (and all other similar relatively close vehicles which are intended to be warned) immediate awareness of the presence of a nearby second vehicle, such as an emergency vehicle or the like, which usually is provided with an emergency vehicle siren for this purpose, but which may not be heard if the driver of the first vehicle has its windows closed and/or has entertainment equipment within his vehicle operating, especially if it is operating so as to produce a loud output sound which may completely mask the siren sound coming from the nearby emergency vehicle, so that the driver of the first vehicle will not be aware of its presence. This is an extremely dangerous situation since such an emergency vehicle producing such a warning signal sound may be travelling very rapidly and if the driver of the first motor vehicle is unaware of its presence, he will not take proper evasive action and his vehicle may be struck by the rapidly-approaching emergency vehicle, which may cause an extremely serious accident which may result in injury or possible death. It is believed to be evident that the provision of a warning-signal-producing apparatus which would completely meet and overcome the above prior art problem by positively alerting the driver of such a vehicle of the presence of such a nearby emergency vehicle would be extremely desirable, and it is precisely this desirable objective, and the overcoming of the above-mentioned prior art disadvantages, which are obtained in and through the use of the novel apparatus of the present invention by reason of the novel features thereof, as set forth hereinafter.

SUMMARY OF THE INVENTION

The apparatus of the present invention comprises a vehicle-presence-indicating, signal-sensing or signal-receiving means carried by a first vehicle for receiving a radio frequency signal emanating from, or transmitted from, a second vehicle (such as an emergency vehicle, or the like) for use in positively indicating the presence of the second vehicle to an occupant of the first motor vehicle carrying said radio frequency signal-receiving means. Said radio frequency signal-receiving means carried by the first vehicle is provided with effective antenna means and is effectively tuned so as to receive a radio frequency warning signal of a predetermined type from the second vehicle (usually an emergency vehicle), and is further provided with means responsive to the reception of such a warning signal by the radio wave receiver to effectively operate switching means for effectively activating warning-signal-producing means within the first vehicle which will then function to produce a perceptible signal which will alert an occupant of the first motor vehicle (especially, a driver thereof) to the fact that the second vehicle (usually an emergency vehicle) is nearby, so that the driver of the first vehicle can take appropriate safety action in order to avoid the possibility of a collision occurring between the second vehicle (emergency vehicle) and the first vehicle. The warning-signal-producing apparatus controlled by the switching apparatus for producing such an in-vehicle, motorist-alerting, perceptible warning signal, may comprise an independent signal producer, such as a visibly perceptible lamp of a flashing or steady-state type or an audibly perceptible signal producer such as a buzzer, bell, siren-sound producer, or the like, adapted to operate in either an intermittent or steady-state manner, or a combination of both said types of signal producer, or the warning signal may comprise the effective intermittent operation of the switching means (or other controlling means responsive to the receiver) for muting or attenuating the sound output of a conventional audio output stage of entertainment equipment within a first motor vehicle, such as a motor vehicle radio, record player, tape player, or the like, which unusual intermittent interruption of the audio output thereof would be so perceptible to an occupant of the first motor vehicle as to, in itself, comprise a warning signal indicative of the nearby presence of the second motor vehicle (usually an emergency vehicle) so that the driver of the first vehicle may take appropriate protective action.

It will be noted that since most present-day motor vehicles are initially sold, or are shortly thereafter provided, with one or the other of the above-mentioned types of entertainment equipment having an audio output stage and an electro-acoustic transducer means, the novel warning-signal-producing apparatus of the present invention need not have its own audio output stage or electro-acoustic means, but may be coupled to the pre-existing audio stage and, subsequently therethrough, to the pre-existing electro-acoustic transducer means already present in the motor vehicle.

It should also be noted that, in one preferred form, the radio frequency receiver adapted to be carried by the first motor vehicle for reception of a warning radio frequency signal emanating from such an emergency vehicle, or the like, may be of a very precisely tuned type, as may the warning signal produced by the corresponding radio frequency transmitter carried by the emergency vehicle for transmitting such a warning signal, so that very slight apparent and perceived changes in the frequency of the received signal, will be immediately sensed by the radio frequency receiver of the first motor vehicle. Indeed, it may be provided with a properly tuned receiving input portion and means responsive to slight frequency deviation or variation, in either or both directions, from the predetermined normal warning-signal frequency, or it may be responsive only to deviation therefrom in a frequency-increasing direction so that said means responsive to such frequency deviation, and associated with the radio wave receiver carried by the first vehicle, may effectively sense and convert such frequency deviation into intelligence indicative of whether or not the source of the radio frequency warning signal (the so-called second vehicle or emergency vehicle) is either approaching or receding with respect to its distance from the first motor vehicle carrying said radio frequency receiver; and means for converting either type of direction-of-movement sensing perception into a corresponding information-providing signal, or display, for the operator of the first motor vehicle may be provided so that said driver will be not only aware of the fact that such an emergency vehicle is in his vicinity, but also will be made aware of whether it is approaching him or receding from him.

In another form of the invention, only such a sensed slight increase in the received predetermined warning signal frequency will be converted into an activation signal, and it will effectively activate, or allow the activation of, the rest of the warning-signal-producing apparatus so that the motorist-alerting, perceptible warning signal will be effectively produced within the interior of the first motor vehicle. Conversely, when the received radio frequency signal is sensed as having deviated slightly in a frequency- lowering direction from the predetermined normal frequency thereof, this will render operative inactivation means associated therewith to effectively inactivate the operation of the switching means and the motor vehicle-mounted warning-signal-producing means so that no perceptible warning signal will be produced within the interior of the first motor vehicle and no attenuation or muting of any entertainment equipment which may be operating therein will occur. The logic of this latter form of operation is the fact that the only time that it is necessary for the operator of the first motor vehicle to be alerted to the presence of the second motor vehicle (or emergency vehicle) is when it is approaching the first motor vehicle and there is the possibility of a collision occurring, which requires appropriate evasive action on the part of the driver of the first motor vehicle. Conversely, when the second motor vehicle (the emergency vehicle) is near to the first vehicle, but is receding from it, there is no necessity for the warning-signal-producing apparatus to alert the motorist or to temporarily attenuate or mute the audio output stage and the electro-acoustic transducer means of any radio or other entertainment equipment which may be operating within the first motor vehicle.

Appropriate band-pass filter means and discriminator means may be employed in the sensing apparatus of the radio frequency receiver, and appropriate amplifier means and, if desired, detector means may also be employed therein, as may suitable electronic power supply means for powering the various stages of the apparatus.

In a preferred form, the radio frequency warning-signal transmitting means in the second vehicle (or emergency vehicle) is adjusted to have a precise power output, and the corresponding radio frequency receiver carried by the first motor vehicle is adjusted to have a precise receiving sensitivity and a precise predetermined extent of gain or amplification therein, and effective gating means may be employed prior to the switching means or the warning-signal-producing apparatus so that operation will not begin until the received and amplified signal reaches a predetermined minimum magnitude which corresponds substantially to a predetermined distance existing between the radio frequency transmitter carried by the second vehicle (emergency vehicle) and the radio frequency receiver carried by the first vehicle, thus limiting the reception of an activating warning signal by the radio frequency receiver carried by said first vehicle to a situation wherein the second vehicle (emergency vehicle) is spaced within a predetermined distance of said first vehicle. This causes the entire warning-signal-producing apparatus to be effectively inoperative when the separation between the second vehicle (emergency vehicle) and the first vehicle exceeds said predetermined distance.

In one preferred form, the radio-frequency-signal-transmitting means (frequently referred to herein as the radio frequency transmitter) carried by the second vehicle mentioned above (which is usually an emergency vehicle) is provided with transmitted signal-power-modifying means for modifying the output power of the emitted radio frequency signal from a predetermined normal magnitude thereof (which in some cases may correspond to a predetermined normal activation distance from such a vehicle which is to be warned at a distance, either on an absolute, non-variable basis or on a variable basis corresponding to closing speed of travel of the two vehicles). The transmitted signal-power-modifying means may be arranged to vary or modify the radiated output power emitted from the radio frequency transmitter, carried by the second (emergency) vehicle, as a direct function of the closing relative speed of travel of the second (emergency) vehicle with respect to the first vehicle (which carries a corresponding radio-frequency-signal-receiving means) whereby to increase the radiated power transmitted from the transmitter in correspondence with increasing speed of closing travel of the second (emergency) vehicle toward the first vehicle, which will thus provide a very nearly constant warning time interval between the reception of such a warning signal (and the effective through-passing of same relative to interior gating means associated with the receiving means in the first vehicle) and the first possible arrival time of the emergency vehicle at the location of the first vehicle so that the occupant of the first vehicle will, in effect, have been provided with a predetermined warning time interval between the time when an occupant of the first vehicle is alerted by the production within the first vehicle of the perceptible warning signal and the subsequent time when the rapidly approaching second (emergency) vehicle reaches a point immediately adjacent to the first vehicle and, in the absence of such a warning, might have a collision therewith. In this modification the gating means carried by the receiving means is arranged to only effectively pass a received signal of a predetermined magnitude and to cause the operation of the perceptible-warning-signal-producing means as a result of said received and gated signal being in excess of a predetermned magnitude—all received signals of lesser magnitude being effectively rejected and being inoperable insofar as the switching means and the perceptible-warning-signal-producing means are concerned.

OBJECTS OF THE INVENTION

With the above points in mind, it is an object of the present invention to provide a novel vehicle-presence-indicating apparatus for both producing a warning signal within the interior of a first motor vehicle to indicate the exterior presence of a particular kind of second motor vehicle (which may include any of several different types, but especially of an emergency vehicle) and to also effectively temporarily attenuate or mute the sound-emitting portion of any radio, or other entertainment apparatus, within the receiving first motor vehicle which may emit a sound within the interior thereof, so that an occupant of the receiving first motor vehicle will be able to hear an interior warning signal produced within the first motor vehicle as a consequence of the fact that the presence nearby of the second vehicle (emergency vehicle) has been sensed, thus providing a positive motorist-alerting, warning apparatus which will positively provide the motorist with information indicating the presence nearby of the particular kind of second motor vehicle which is to be sensed (such as an emergency vehicle).

It is a further object to provide novel apparatus of the character set forth herein, which additionally employs controlling or switching means for intermittently interrupting the sound produced by a radio, or other entertainment equipment in response to receipt of a radio signal indicating the nearby presence of an emergency vehicle, or the like; said intermittently interrupted sound acting as a perceptible warning signal of the type referred to in the preceding object, indicating the presence nearby of such an emergency vehicle, or the like.

It is a further object to provide a novel apparatus of the character set forth herein which is distance-responsive so that it will respond to the presence of an emergency vehicle, or the like, and will produce a corresponding warning signal within the motorist's vehicle only when said emergency vehicle is within a predetermined distance of the motorist's vehicle adapted to sense same.

It is a further object of the present invention to provide novel apparatus of the character set forth herein which is responsive to the direction of movement of the sensed nearby emergency vehicle, or the like, so as to only produce within the sensing vehicle a perceptible warning signal alerting the motorist when the nearby emergency vehicle is approaching the sensing vehicle and, conversely, to not activate and to not produce such a perceptible warning signal within the sensing vehicle when the emergency vehicle is receding from the sensing vehicle.

It is a further object of the present invention to provide apparatus of the character referred to herein which is so arranged as to effectively attenuate, mute, or reduce to a very low-volume level, the sound produced by any radio, tape player, or any of various different types of entertainment equipment, to which the apparatus of the present invention has been attached, and which further is so arranged as to provide a dummy load in the circuitry of such equipment so as to prevent any damage from occurring to any of the stages thereof by reason of the temporary muting operation of the novel apparatus of the present invention.

It is a further object of the present invention to provide novel perceptible warning-signal-producing apparatus in association with a radio frequency warning signal receiver, which is adapted to produce one or more types of extremely perceptible warning signals, which may include a visibly observable warning light, an audibly perceptible warning signal, or a very distinctive siren-like sound, or any combination of same, operated either intermittently or in a steady-state condition, so as to provide a maximum degree of warning to the vehicle occupant of the nearby presence of an emergency vehicle from which the radio frequency warning signal has emanated.

It is a further object of the present invention to provide apparatus of the character referred to herein which includes as a part of the complete system, the radio frequency warning-signal-producing transmitter means adapted to be carried by the spaced, but nearby, approaching emergency vehicle for reception by a corresponding radio vehicle for operation of perceptible warning-signal-producing frequency receiver carried by a second, signal-sensing apparatus carried thereby, as indicated hereinbefore.

It is a further object of the present invention to provide novel apparatus of the character referred to herein, which is both distance-responsive and also responsive to closing relative speed-of-movement of the sensed, nearby emergency vehicle relative to the sensing vehicle carrying the sensing equipment. The arrangement is such that, when said closing speed is of relatively low magnitude, the distance-responsive characteristic operates at one distance which is so spaced from the sensing vehicle as to provide an adequate time interval for a driver or occupant of the sensing vehicle to take proper safety or evasive action in order to avoid any possibility of a collision occurring between the approaching sensed vehicle and the sensing vehicle. However, the apparatus is also arranged, as a function of increasing closing speed of the sensed vehicle toward the sensing vehicle, to modify the distance-responsive characteristic so as to effectively increase same to a substantially greater activation or warning distance than in the previously mentioned slow-closing-speed situation. The purpose of this arrangement is to provide a relatively constant warning time interval to the occupant of the sensing vehicle, indicating the approach of the sensed vehicle, and with the substantially constant time interval being such as to allow for proper protective action by the occupant of the sensing vehicle.

It is a further object of the present invention to provide novel apparatus of the character referred to herein, generically and/or specifically, which may include any or all of the features referred to herein, either individually or in combination, and which is of relatively simple, inexpensive, easy-to-use, easy-to-mount (either individually or in association with pre-existing motor vehicle-mounted entertainment equipment), and easy-to-manufacture construction suitable for ready mass manufacture and distribution of the apparatus (either as original motor vehicle-mounted equipment or as separate, individual equipment for mounting after the original manufacture of a motor vehicle on such a pre-existing motor vehicle) at relatively low cost per unit, both as to initial capital cost (including production set-up cost, etc.) and as to the subsequent per unit manufacturing cost, whereby to be conducive to widespread production, distribution, sale, and use of the invention as original motor vehicle equipment, or as a separate kit for subsequent installation and mounting on a pre-existing motor vehicle, for the purposes outlined herein or for any substantially equivalent or similar purposes.

Further objects are implicit in the detailed description which follows hereinafter (which is to be considered as exemplary of, but not specifically limiting, the present invention), and said objects will be apparent to persons skilled in the art after a careful study of the detailed description which follows.

For the purpose of clarifying the nature of the present invention, several exemplary embodiments of the invention are illustrated in the hereinbelow-described figures of the accompanying drawings and are described in detail hereinafter.

BRIEF DESCRIPTION OF THE DRAWINGS

FIG. 2 illustrates in block diagrammatic form the optional phantom-line inclusion of more than one audio stage (and corresponding electro-acoustic transducer means) which would be the case if a stereophonic or dual-channel entertainment apparatus is provided instead of a monaural apparatus, as illustrated in solid lines in FIG. 2. Additional leads (but not the remainder of the systems) are also shown for use in providing a four-stage output system for quadraphonic sound reproduction purposes. These are merely optional alternates to the basic system illustrated in block diagrammatic form in FIG. 2.

FIG. 3 is a fragmentary view similar in many respects to FIG. 2, but illustrates a further slight modification thereof which includes means for precisely regulating the strength of the transmitted radio frequency signal emitter from the emergency vehicle and also illustrates means for very precisely controlling the sensitivity of the radio frequency receiver carried by the first motor vehicle and including what might be termed gate or limiter means of a "go" or a "no go" type so that received signals will only be operative for causing the activation of the perceptible warning signal in the first motor vehicle when the second motor vehicle (emergency vehicle) is within a predetermined distance of the first motor vehicle carrying the radio frequency receiver.

In FIG. 8, such an intermittent interrupter is shown in solid lines in the output of the radio-frequency receiver and, optionally, as an alternate thereto, is shown in phantom lines in the radio frequency transmitter adapted to be carried by an emergency vehicle, and it is understood that one or the other is employed.

DESCRIPTION OF THE PREFERRED EMBODIMENTS

Figure 1:
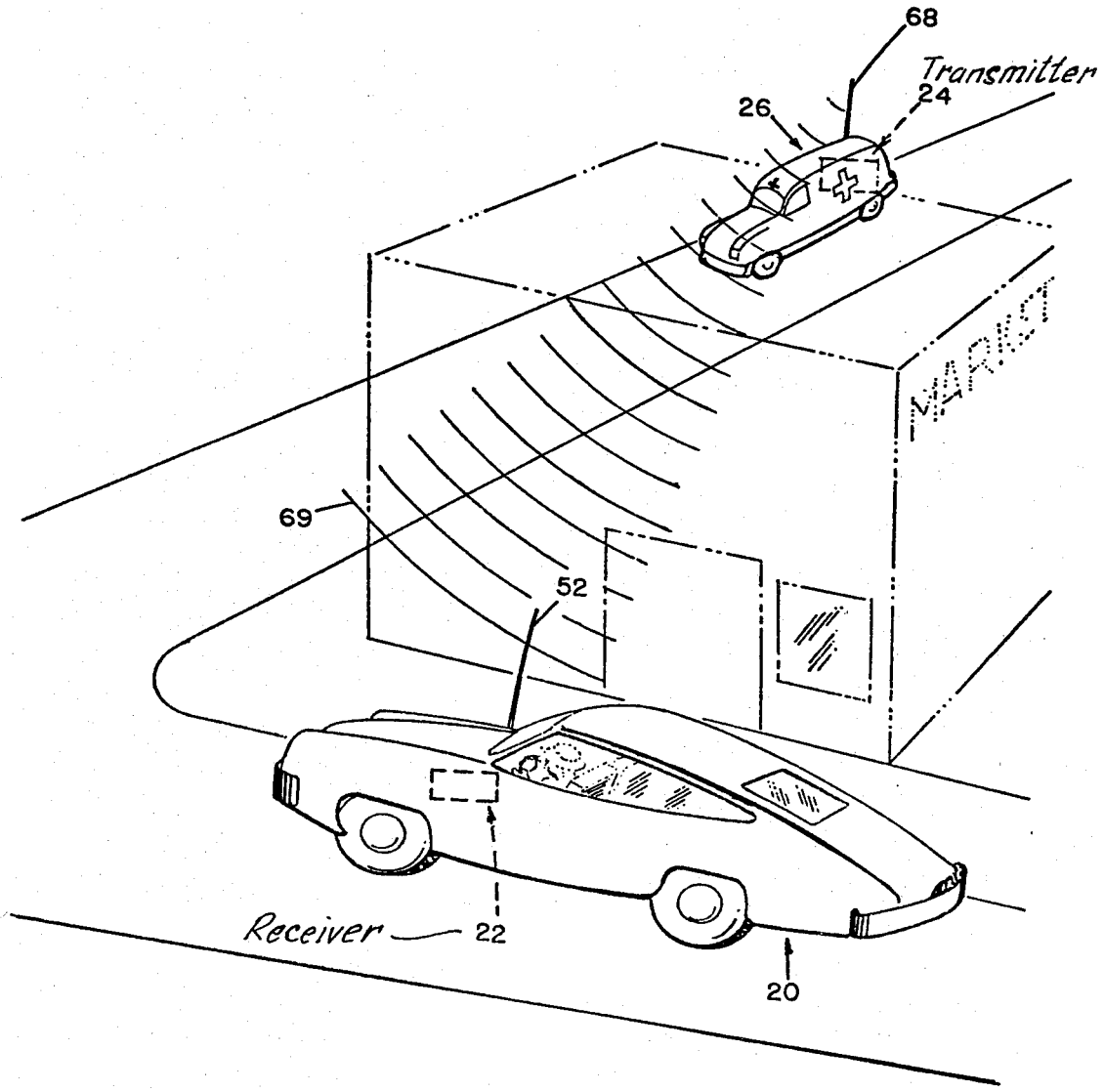
FIG. 1 is a greatly reduced-size, somewhat diagrammatic view illustrating an exemplary first motor vehicle provided with one representative form of the radio wave receiving and perceptible signal producing portions of the novel warning-signal-producing apparatus of the present invention and also illustrating an exemplary second motor vehicle (such as an emergency vehicle or the like) which is within a predetermined distance of the first motor vehicle and is approaching same and which carries the radio frequency transmitting portion of the novel warning-signal-producing apparatus of the present invention.

FIG. 1 shows in a very diagrammatic form one exemplary representative form of the present invention wherein a first motor vehicle is illustrated in exterior perspective form at 20 and is shown as being provided with radio-frequency-signal-receiving means indicated generally at 22. The radio-frequency-signal-receiving means carried by the first vehicle 20 is effectively tuned to and adapted to receive a particular vehicle-presence-indicating signal which is shown, in the example illustrated diagrammatically in FIG. 1, as comprising the output radio-frequency-transmitted signal 69 emanating from a radio-frequency-signal-transmitting means, indicated at 24 as being carried by a second motor vehicle, which is also shown in perspective in this view, as indicated at 26, which may comprise an emergency vehicle, such as an ambulance, fire engine, police car, or the like. Radio-frequency-signal transmitting means 24 may be modulated in certain forms of the invention and, in some other forms thereof, may be of an effectively unmodulated type, but in either case it is of a precisely predetermined type, usually of limited range so as to avoid interfering with other radio-frequency-signal-receiving equipment, such as conventional radios, television sets, and the like, and particularly so as to not interfere with other important national defense or emergency equipment, and it is intended to be received only by the particular kind and type of radio-frequency-signal-receiving means, such as that shown at 22, carried by any of a plurality of vehicles within a predetermined and relatively short distance from the transmitter. Of course, only one representative receiving first vehicle 20 is illustrated, but it should be understood that it is representative of a large number of vehicles which may be on the road and travelling in the vicinity of the emergency vehicle 26. In fact, the ultimate objective of the invention would be for all vehicles to be provided with such radio-frequency-signal receivers 22 tuned to the particular warning radio frequency signal transmitted from the emergency vehicle 26 so that all such other vehicles will be alerted to the presence of such an emergency vehicle in the vicinity and can take proper protective safety and/or evasive action if necessary, such as pulling the vehicle 20 over to the side of the road until the emergency vehicle 26 has passed and there is no danger of a collision occurring. This is the purpose of all of the various forms of the invention, and FIG. 1 is intended to be a diagrammatic showing of this essential feature of the present invention. More details are disclosed with respect to several differrent exemplary versions of the invention in various succeeding ones of the figures of the drawings, as will be described in detail hereinafter.

Figure 2:
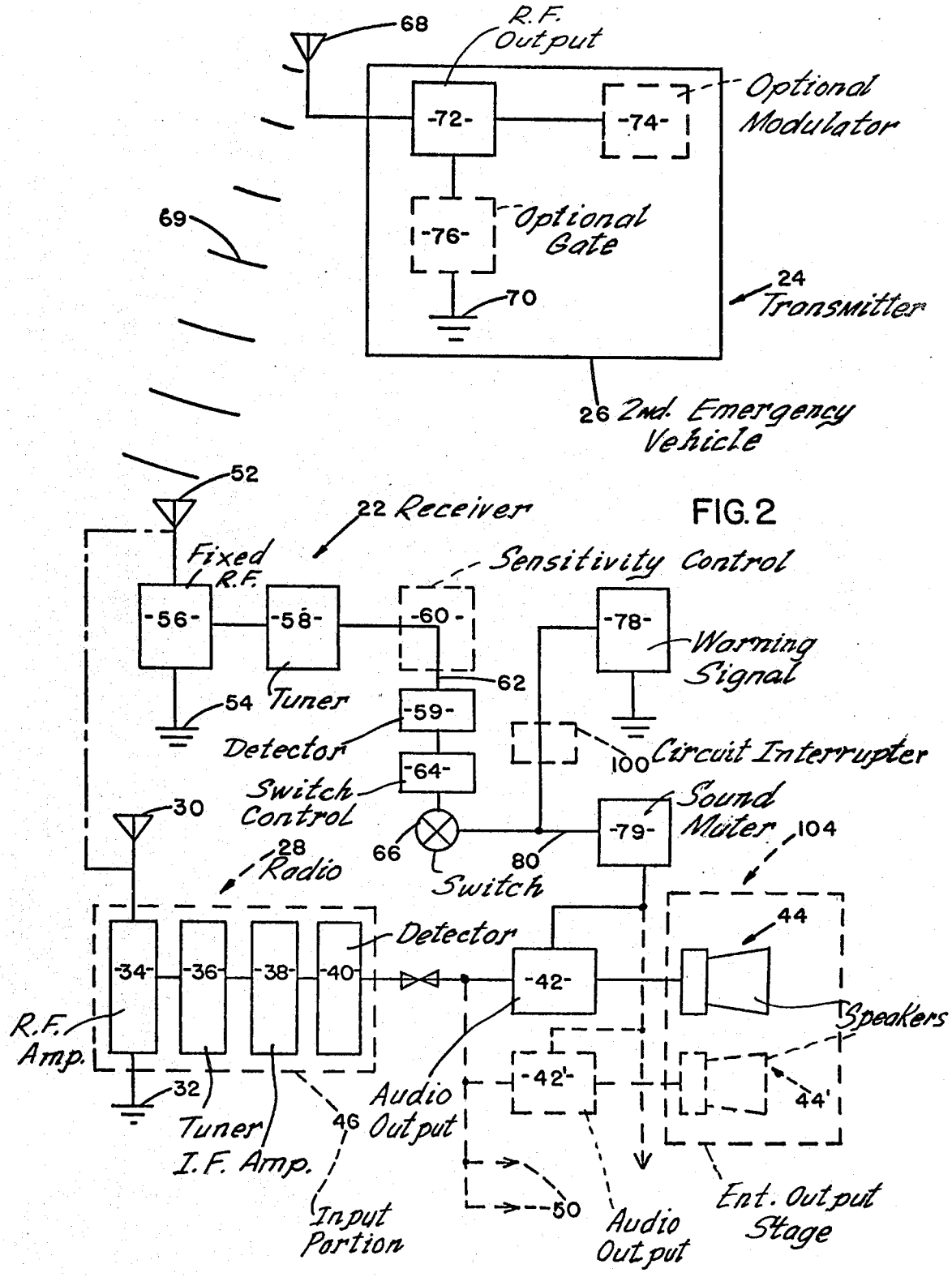
FIG. 2 is a diagrammatic, partially schematic view illustrating in block diagrammatic form both the radio frequency transmitting portion of the apparatus carried by the second or emergency vehicle of FIG. 1 and the radio frequency receiving and perceptible signal producing apparatus carried by the first vehicle of FIG. 1 in a first representative form thereof wherein the received radio frequency warning signal is effectively detected and is coupled with respect to the audio output stage, and succeeding electro-acoustic transducer means, of a pre-existing entertainment apparatus initially carried by the first motor vehicle. In the example illustrated in FIG. 2, said entertainment apparatus comprises a motor vehicle radio. However, it should be noted that the audio stage and electro-acoustic transducer means are indicated in the drawing as being removably coupled to the entire input portion of the radio which is enclosed in a phantom-line diagrammatic block to indicate that it may be effectively replaced by the corresponding input portion of various other kind of entertainment apparatus, such as a record player, a tape player, or the like. Also

FIG. 2 is a somewhat more detailed view illustrating the system and apparatus of FIG. 1, but showing the transmitting apparatus 24 carried by the second emergency vehicle 26 in a little more detail than illustrated in FIG. 1 and also showing the receiving apparatus 22 carried by the first motor vehicle 20 in somewhat greater detail. It should also be noted that in FIG. 2 the radio-frequency-signal-receiving means 22 carried by the first vehicle 20 takes advantage of and employs the audio output stage 42 and the succeeding electro-acoustic transducer means stage 44 of a pre-existing entertainment apparatus initially carried by the first motor vehicle 20 and which is indicated generally at 28 and, for exemplary purposes only, takes the form of a conventional automobile radio which has an antenna 30 and a ground 32 coupled to an input radio frequency stage 34 coupled to a tuner stage 36 and, in the case of a superheterodyne type reciever, is adapted by means of beat frequency coupling with respect to an oscillator, to be fed through an I.F. stage 38 and thereafter through a detector stage 40 and then to an audio output stage 42 which, in turn, is coupled to electro-acoustic transducer means indicated generally at 44.

It should be clearly understood that the particular kind of radio shown at 28 is merely representative of a conventional superheterodyne receiver and is not in any way intended to limit the type of radio employed, which may be an R.F. type not employing the superheterodyne principle or which may be a regenerative or super-regenerative type of receiver and which is not limited to either amplitude modulation or frequency modulation, but may be either or both. Furthermore, the receiver may be of a type intended for conventional broadcast-band reception, in either or both of the AM and FM categories, or for the reception of shortwave frequencies; police, fire, and emergency-band frequencies; conventional time-signal frequencies; or any combination thereof. The point to be noted is that the type of radio is totally non-limiting.

It should also be noted that many motor vehicles are today provided with various other types of entertainment equipment having audio output stages and subsequent electro-acoustic transducer means stages similar in essence to the representative ones shown at 42 and 44 in FIG. 2 and which may be of single channel or multiple channel types such as for monaural sound reproduction, binaural or stereophonic sound reproduction, and/or quadraphonic sound reproduction, etc. Since various other forms of entertainment equipment, such as record players, tape players, cassette and/or cartridge players, and other types of sound-reproducing equipment of single track, multiple track, or other forms, are often provided in motor vehicles, and since all such equipment has an audio output stage and electro-acoustic transducer means stage, the only difference thereof from the representative radio shown at 28 is in the input portion of the apparatus, which, therefore, is shown enclosed in a phantom-line, block-diagrammatically-shown box 46 in order to illustrate the fact that the entire input portion of the entertainment apparatus of FIG. 2 can be replaced and, thus, can comprise any of the various different types of entertainment apparatus referred to above or any other equivalent entertainment apparatus. This view also shows the optional inclusion of more than one audio stage and correspondingly more than one electro-acoustic transducer, means by illustrating same in broken lines at 42' and 44', respectively, and by showing additional optional audio stage leads at 50 for use in providing a representative four-stage output system for quadraphonic sound reproduction purposes. These are merely optional alternates to the basic monaural system illustrated in solid lines in FIG. 2 with respect to the audio output stage 42 and the electro-acoustic transducer means stage 44.

FIG. 2 illustrates the previously-mentioned radio-frequency-signal-receiving means 22 as comprising an antenna 52, a ground 54, and a fixed radio frequency stage 56 feeding into a tuner, indicated in block diagrammatic form at 58, with the fixed radio frequency stage 56 and tuner 58 being tuned precisely so as to correspond to the transmitted signal from transmitter means 24 carried by the emergency vehicle 26 so as to receive and pass only that particular transmitted signal and, by reason of the limited strength of the radiated transmitted signal and also the adjustment, setting, amplification, and gain of the receiving means 22, being limited to receiving the transmitted signal, only within a predetermined relatively short distance. This may be enhanced by the provision of optional gate means or limiter means, such as that shown in phantom lines in block diagrammatic form at 60 in FIG. 2, operative for preventing the through-passing of any received signal unless it is in excess of a predetermined magnitude. Any such through-passed signal from the receiving means 22 will then be fed through a detector 59 and a representative electrically conductive lead 62 to switch control means, indicated in block diagrammatic form at 64, and switch means indicated at 66, for effective coupling to the audio output stage 42 and subsequently therethrough to the electro-acoustic transducer means stage 44.

In FIG. 2, the transmitting means, indicated generally at 24, includes antenna means 68, ground means 70, a radio frequency output stage 72 positioned therebetween, an optional modulator means indicated at 74, and an optional gate or power-limiting means, indicated in block diagrammatic form at 76, and, of course, appropriate power supply means (not shown). The arrangement is such that if the modulator means 74 is employed, the radio frequency signal 69 of a predetermined and precisely powered type is appropriately modulated in a desired manner and radiated from the antenna 68 carried by the emergency vehicle 26 for reception by any receiving means 22 carried by any nearby vehicle, such as the representative one shown at 20, only within a predetermined distance. If the optional modulator 74 is eliminated, then the unmodulated, but precisely-powered, radio frequency signal 69 is radiated from the antenna 68 for such reception by the receiver means 22 of all such nearby vehicles 20. In the exemplary arrangement illustrated in FIG. 2, the transmitter 24 is adapted to produce a precisely power-limited magnitude of output radiated radio frequency power so that it will not be receivable beyond a predetermined relatively short distance therefrom so as to avoid interference with other signals in the radio frequency spectrum. In the exemplary form of the apparatus illustrated in FIG. 2, said power-limiting means or gate means is indicated in optional block-diagrammatic form at 76 and no further detailed structure is thought necessary or desirable in view of the fact that such power-limiting means or gate means are well-known in the electronic art.

It should also be noted that, in FIG. 2, a separate perceptible warning-signal-producing means is indicated diagrammatically at 78 and is shown connnected by a lead line 80 to the switching means 66. This is for the purpose of diagrammatically illustrating an arrangement where the perceptible warning signal is to be separate and distinct from the audio output stage 42 and electro-acoustic transducer means stage 44 thereof, which is merely attenuated or muted during the period when the perceptible warning-signal-producing means 78 is rendered operative by the switching means 66. Alternatively, the perceptible warning-signal means may actually comprise the audio stage 42 and the electro-acoustic transducer means 44 provided with an appropriate intermittent circuit interrupter or the like in circuit therewith for causing the audio output of the entertainment apparatus 28 to be intermittently interrupted in a manner which will be clearly perceptible to an occupant of the motor vehicle 20 and will thus comprise the warning signal indicating the nearby presence of the emergency vehicle 26. One such exemplary alternative arrangement with respect to the warning-signal-producing means is described fragmentarily in greater detail hereinafter with reference to FIG. 7.

Figure 2A:
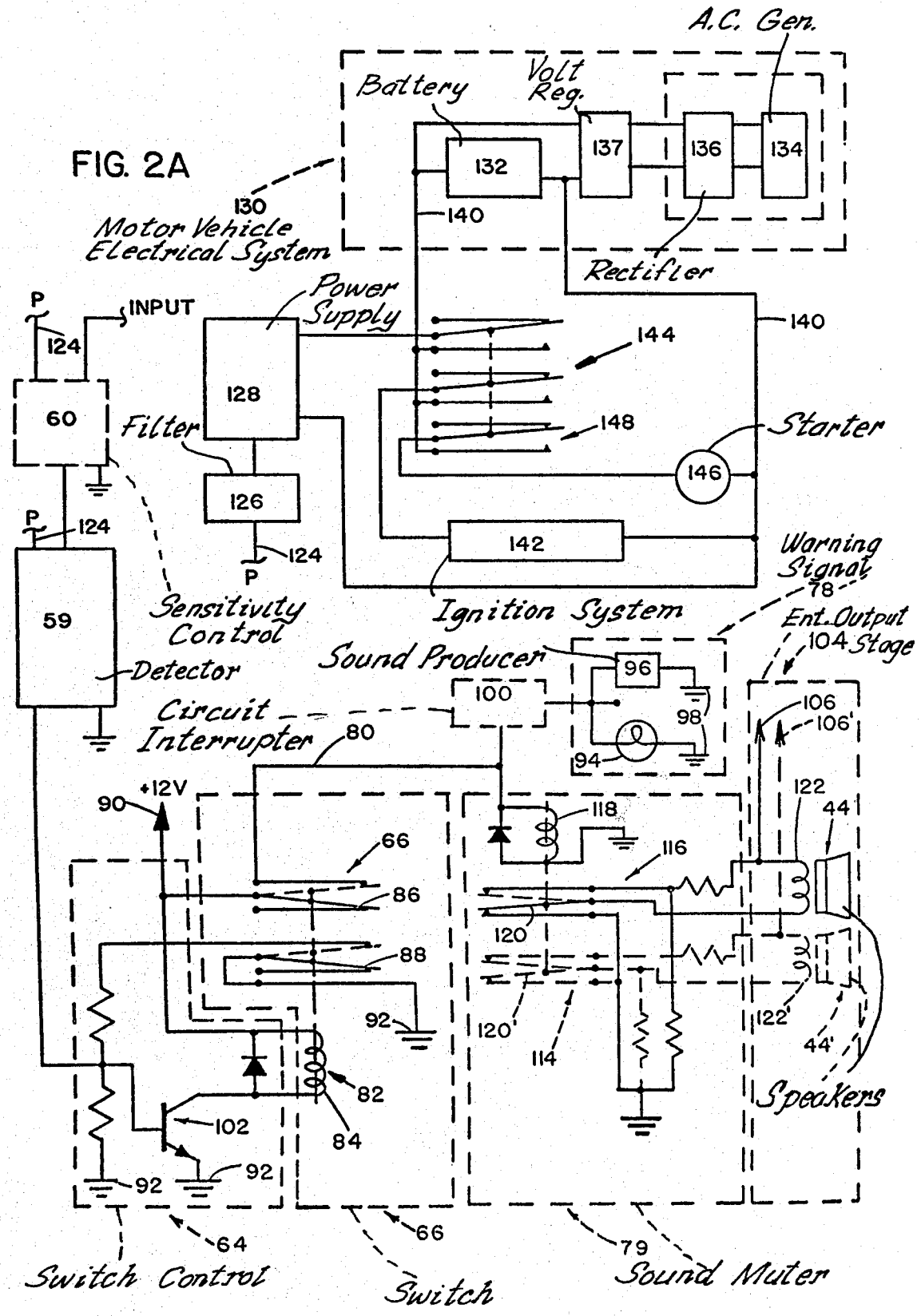
FIG. 2A merely illustrates a partially-more-detailed showing of portions of the FIG. 2 form of the invention which is accomplished by illustrating certain portions thereof in electrical schematic form in a particular representative but non-specifically-limiting form in lieu of the substantially completely block-diagrammatically-shown portions thereof illustrated in FIG. 2.

FIG. 2A illustrates one exemplary form of circuit schematic (which is not to be construed in a specifically limiting sense) which corresponds generally to a portion of the block-diagrammatically-shown receiving means of FIG. 2 and illustrates in a somewhat more detailed way representative but non-limiting circuit forms which the corresponding block-diagrammatically-shown portions of the over-all apparatus may take. For example, in FIG. 2A it should be noted that the sensitivity control means indicated in block diagrammatic form at 60 in FIG. 2 may take a particular circuit form which determines the over-all sensitivity of the apparatus. However, it may take a form wherein it comprises an actual "go" or "no go" gate which will only allow an output signal therefrom when an input signal thereto is in excess of a certain predetermined magnitude and will allow no output signal to exist whatsoever when the input signal thereto is below such a predetermined magnitude. On the other hand, the effective sensitivity control means 60 may merely adjust the magnitude of the output signal with respect to the magnitude of the input signal so that after subsequent detection and the feeding of the detected signal into the switching means control means, indicated diagrammatically at 64, it will only be capable of operating the switching means, indicated at 66 and controlled thereby, if the original input signal into the sensitivity control means 60 is in excess of such a predetermined magnitude and at all values below said predetermined magnitude, the resultant signal at the output of the switching means control means 64 will be insufficient to operate the switching means 66. This of course is functionally the same thing as an actual electronic gate and either type of arrangement or any functional equivalent thereof may be used in lieu of the specific arrangement shown for exemplary purposes only, in FIG. 2A.

In any event, the output of the sensitivity control means (or gate) 60 is fed into the input side of the detector means, indicated in block diagrammatic form at 59, which effectively detects or de-modulates the signal and feeds it into the switching means control means, indicated in block diagrammatic form at 64, wherein a transistor-controlled relay, indicated generally at 82, controls the effective energization and de-energization of the relay coil 84 for movement of the pair of moving switch elements 86 and 88 of the double-pole, double-throw relay switching means, which is indicated generally at 66, between the normally switch-open positions thereof as shown in FIG. 2A and the alternate, activated, switch-closed positions thereof as shown in broken lines in FIG. 2A. In the example illustrated, the controlling relay coil 84 is adapted to be energized from a conventional motor vehicle electrical power supply, such as the conventional electrical system of a motor vehicle which usually includes a DC generator or rectified alternator 134 coupled, by way of a voltage regulator 137, with respect to one or more 12-volt storage batteries 132. Thus, the positive terminal of the entire switching means control means 64 and switching means 66 is provided with appropriate 12-volt positive potential at the terminal 90, which is adapted to be connected to the positive terminal of the motor vehicle electrical system and/or storage battery. Three other terminals of said combination switching means control means 64, and switching means 66, are shown grounded as indicated at 92, which of course means that they are connected effectively to the opposite side of such a motor vehicle electrical system since the negative terminal of the storage battery, and the rest of the electrical system, is customarily grounded to the chassis or frame of the motor vehicle (although this particular connection arrangement is not to be construed in a specifically limiting sense).

It should be noted that the upper moving relay switching arm 86 is adapted to close the circuit connected to the previously-mentioned lead line or electrical conductor 80, thus connecting the power terminal 90 to the warning-signal-producing means 78, which, in the example illustrated, is shown as comprising an electic light or lamp, as indicated at 94, and also an audible sound producer 96, such as a buzzer, bell, or small siren-like sound producer. In the example illustrated, both the audible sound producer 96 and the visible light producer 94 are connected in parallel on the input side and are grounded on their output sides as indicated at 98, thus completing the power-supplying circuit to both of said perceptible warning-signal-producing means 94 and 96 whenever the relay switching coil 84 is temporarily energized so as to operate the upper relay switching arm 86 into the upper position temporarily applying power from the motor vehicle electrical system and power supply to said perceptible warning-signal producing means 78. In the exemplary arrangement illustrated, in order to enhance the attention-getting effect of the two different perceptible warning-signal-producing members comprising the lamp 94 and the audible sound producer 96, an intermittent circuit-interrupter may optionally be placed in circuit therewith, as indicated at 100, and may comprise any desired type of circuit interrupter such as the conventional motor vehicle flasher unit employed in turn-indicator signals, and the like, which is frequently of a thermal type, although it may be of an electromagnetic type, a pneumatic type, mechanical type or any of a variety of other types of intermittently operated circuit interrupters which are essentially functionally equivalent to the exemplary arrangement just referred to above.

The arrangement of the switching means control means, indicated generally at 64, is such that when a proper magnitude of detected input signal is fed thereinto, and only under such conditions, the biasing of the transistor, indicated generally at 102, will be changed sufficiently to allow conduction therethrough, and through the relay switching coil 84, to occur to an extent such as to operate the two relay switching arms 86 and 88 from their normal switch-open positions into their temporary switch-closed positions as shown in broken lines in FIG. 2A. When this occurs, as previously mentioned, the warning-signal-producing means, indicated generally at 78, is temporarily activated until such time as the input signal fed into the switching means control means 64 falls below a predetermined magnitude, at which time the biasing means (not shown), which normally maintains the two switching arms 86 and 88 in the switch-open conditions (shown in solid lines in FIG. 2A), causes them to return to switch-open positions, which returns the bias of the control transistor 102 to its previous, substantially transistor-non-conductive value, and the switching means 66 is again effectively in switch-open, inactivated condition, as is the perceptible warning-signal-producing means 78. This is also true of the entertainment sound-output muting means, which is indicated generally at 79 and which, as illustrated in FIG. 2A, is also controlled by the temporary closing activation of the upper relay switching arm 86 so as to be activated concurrently with the activation of the previously-mentioned perceptible-warning-signal-producing means 78, and to be inactivated concurrently therewith, also, in the absence of an input signal of the proper magnitude into the switching means control means 64. In the example illustrated, a monaural entertainment sound output muting means portion for use with the audio output stage of pre-existing entertainment equipment already mounted in the motor vehicle is shown in solid lines. However, since such pre-existing entertainment equipment is very often of a binaural or stereophonic type, the extra channel thereof is shown in broken lines in FIG. 2A and the extra portion of the entertainment sound output muting means for controlling same is also shown in broken lines in FIG. 2A.

An output part of the entertainment equipment, such as transducer means 44 and 44' of FIG. 2 coupled to the corresponding audio output stage portions as indicated at 42 and 42' in FIG. 2, is shown in part in FIG. 2A in an entertainment output stage, diagrammatically-shown in block form at 104. It is further shown as comprising the audio leads 106 and the broken-line audio lead 106' connected, respectively, to electro-acoustic transducer means shown in solid lines at 44 and in broken lines at 44'. Of course it should be understood that the broken-line audio lead 106' and the corresponding electro-acoustic transducer means 44' may be eliminated, as may the entire lower entertainment muting means portion, indicated generally in broken lines at 114, or it may be supplemented by additional similar electro-acoustic transducer means emanating from different audio output channels and controlled by corresponding additional entertainment sound output muting means portions similar to the broken-line representative one shown at 114. In other words, any desired number of audio output channels may be correspondingly controlled by corresponding muting means portions. The single channel arrangement shown in solid lines and generally indicated at 116 in FIG. 2A, and the broken-line similar muting means portion indicated at 114, are thought to be entirely adequate as a showing of any desired number of such muting means portions for controlling any desired number of audio output portions and electro-acoustic transducer means portions. In the exemplary arrangement illustrated, the first solid line electro-acoustic transducer means 44 is fed from the audio lead 106 and normally follows the appropriate path to ground as indicated in the circuit schematic of FIG. 2A. However, when the previously-mentioned switching means, indicated generally at 66, is activated and the switching arms 86 and 88 are moved upwardly into the broken-line alternate activated position of FIG. 2A, power is applied from the motor vehicle electrical system to the muting means relay coil 118, which moves the two movable switch arms 120 and 120' to the broken-line activated positions shown in FIG. 2A, which effectively reduces or greatly attenuates the amount of current fed through the corresponding voice coils 122 and 122' from the two audio input leads 106 and 106', respectively, while at the same time effectively switching in a dummy load provided by the additional shunt resistance path to ground. This action has the effect of greatly attenuating sound radiated from either of the electroacoustic transducer means 44 and 44' and yet effectively providing an appropriate output load for the corresponding output portions of the entertainment equipment. This is often important, since a substantial variation in the output load may cause equipment damage and malfunction. As soon as the activating signal has been removed from the lead 80 by reason of effective inactivation of the switching means 66, the two muting relay switch arms 120 and 120' will return to their normal solid-line positions shown in FIG. 2A (into which positions they are normally spring-biased by conventional means not shown), which will immediately effectively remove the by-passing shunt resistance paths to ground for the two voice coils 122 and 122' and return them to full-scale, not-attenuated and non-muted operation. This will of course occur at the same time that the warning-signal-producing means 78 is also effectively inactivated.

It should be noted that appropriate power for the switching means control means 64, the switching means 66, and also for the muting means 79, is provided, in the example illustrated, by the connection of the terminal 90 directly to the electrical system of the motor vehicle 20 carrying the entire vehicle-presence indicating receiving means 22. However, the detector means 59 and the gate means or sensitivity control means 60 and any earlier electronic portions of the receiver means 22 may be powered from an appropriate electronic power supply means suitable for such electronic equipment, which may be the same electric power supply means employed for powering the entire input portion of the entertainment equipment 28. In the example illustrated, this is shown as comprising a connection by a lead 124, usually through a filter such as indicated in block diagrammatic form at 126, to a conventional electric power supply means for electronic equipment of the type illustrated, which is generally indicated in block diagrammmatic form at 128. It may be connected at its input to the conventional motor vehicle electrical system and the conventional DC input thereto may be appropriately converted to AC by vibrator means, or any functional equivalent, appropriately modified as to voltage and current by suitable transformer means, subsequently rectified back into DC power of proper electrical characteristics for powering electronic apparatus of the character illustrated and then fed through the previously-mentioned filter 126 for smoothing the output-rectified DC power from the electric power supply means 128 to any desired degree.

In the exemplary form illustrated in FIG. 2A, the conventional motor vehicle electrical system is illustrated in broken-line block diagrammatic form at 130 and is shown as comprising a conventional DC storage battery 132 and a conventional alternator 134 and rectifier 136 operating, under the control of a voltage regulator 137, for maintaining the proper charge on the storage battery 132 at all times. The motor vehicle electrical system output leads 140 are connected to the ignition system, shown in block diagrammatic form at 142 (which is not illustrated since such ignition systems are well-known in the art), and are also connected to composite starting switch means, indicated generally at 144, which control the appropriate application of electrical power to the ignition system 142, the starter 146, and the previously-mentioned electric power supply means 128 substantially simultaneously when the starting switch is operated into the "on" position, although the switch element 148 controlling the energization of the starter motor 146 is arranged to normally be the last one energized of the various apparatuses just mentioned, as is customary in such motor vehicle starting switches.

FIG. 3 is a view similar to portions of FIG. 2 and FIG. 2A, but illustrates a slight modification thereof wherein the sensitivity control means 60 of FIGS. 2 and 2A is modified from a sensitivity control means of the type previously described in connection with FIGS. 2 and 2A to a conventional "go" or "no go" gate means which may include means for adjusting the magnitude of the minimum through-passing signal and which functions in the conventional manner of gate means to pass no signal at all which is below said minimum gate magnitude and to completely pass a signal which is in excess of the gate magnitude for operating the succeeding portions of the apparatus only when the signal fed into the gate means is in excess of said predetermined or preselected gate magnitude value which is adjusted to correspond to a predetermined spacing between the first and second vehicles.

Since all portions of the apparatus except for the gate means are substantially identical to previously-described forms of the invention, the same reference numerals are used to identify corresponding portions of the FIG. 3 showing of the apparatus, with the exception of the gate means, which is designated by the reference numeral **60*a* since it is modified from the sensitivity control means 60 of the FIGS. 2 and 2A forms. Also, in this slight modification of the invention, in order to provide proper distance and signal-strength correlation for causing the apparatus to operate in the manner just described above, such that the receiving means 22 will only effectively activate the warning-signal-producing means 78 when the second vehicle and the transmitter thereof are within a predetermined distance of the first vehicle carrying the receiving means 22, the transmitter 24 carried by the second vehicle 26 is provided in circuit therewith with a positive power limiter, which is indicated in block diagrammatic form at 150, so that the radio frequency warning signal radiated from the transmitting antenna 68 will have a precise and exactly determined output power so that the setting of the gate 60*a* in the receiving means 22 can be adjusted so that it will only pass a received signal therethrough and activate the perceptible warning-signal-producing means 78 when the second vehicle 26 is within a predetermined distance of the first vehicle 20. Otherwise, the FIG. 3 modification is substantially the same as the previously-described form of the invention illustrated in FIGS. 2 and 2A, and it is thought that any further detailed description of the remaining portions of the apparatus is entirely unnecessary since it would be redundant in view of the detailed description of the operation of the same portions of the invention already set forth hereinbefore in connection with the form of the invention illustrated in FIGS. 2 and 2A**.

Figure 4:
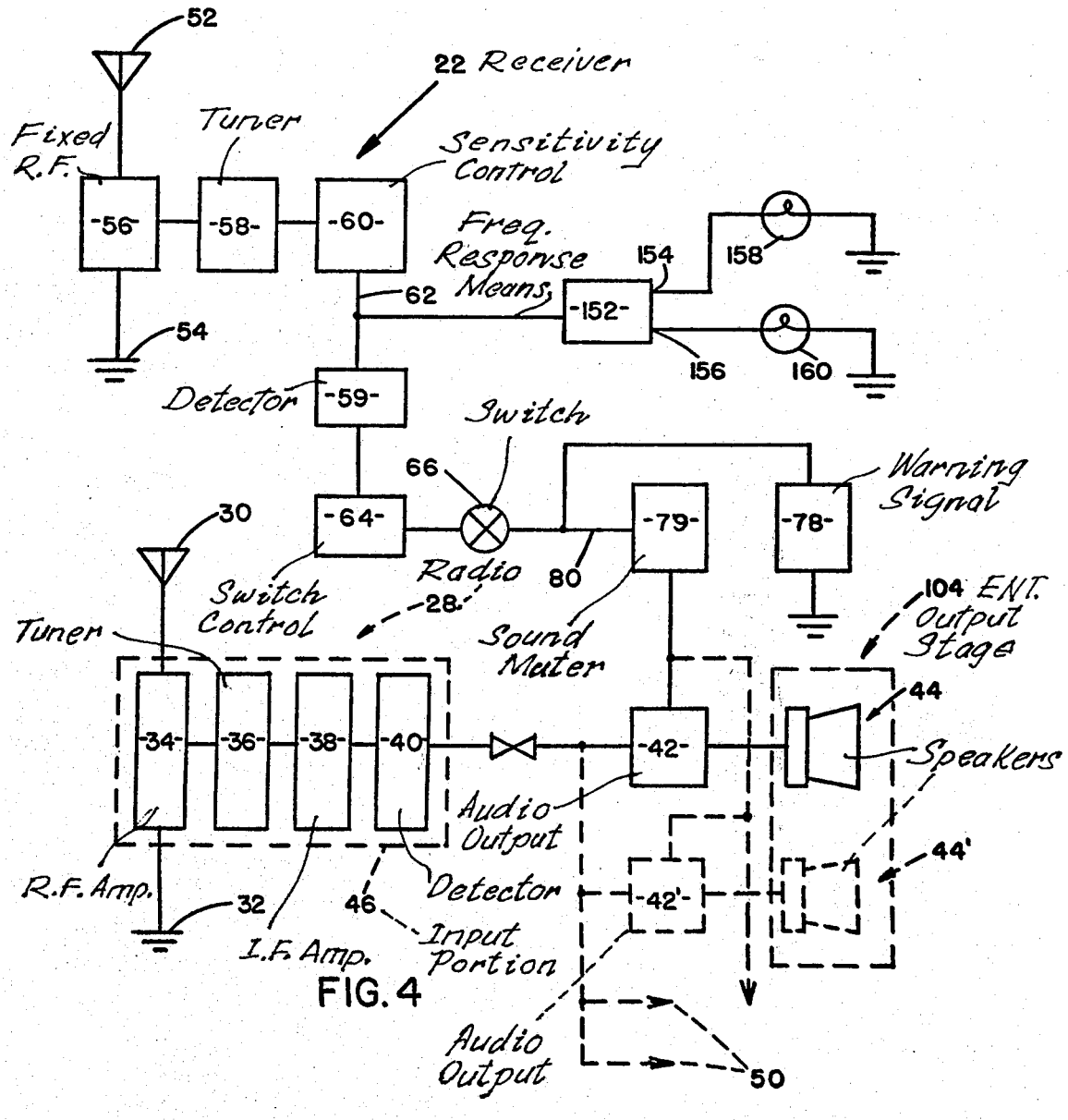
FIG. 4 is a view similar to certain portions of FIG. 2, but illustrating a further modification wherein the radio frequency receiver carried by the first vehicle is provided with means for sensing apparent deviation in the received frequency from a predetermined normal transmitted frequency and for converting this sensed frequency deviation into a direction-of-motor-vehicle-travel output for providing information to the occupant of the first motor vehicle as to whether the emergency vehicle is approaching the first motor vehicle or is receding therefrom.

FIG. 4 is a view similar to portions of FIGS. 2 and 2A, but illustrates a further modification and, therefore, parts which are identical to the form illustrated in FIGS. 2 and 2A are designated by the same reference numerals and additional portions added thereto in this modification are designated by new reference numerals. It will be noted that in the FIG. 4 modification in addition to the main signal received through the tuner means 58 and fed through the sensitivity control means 60 to the detector means 59 and subsequently to the switching means control means 64 and the effective switching means 66 for operating both the warning-signal-producing means 78 and the entertainment equipment muting means 79, there is an additional coupling of the lead from the input of the radio frequency receiver 22 to frequency responsive means, indicated generally at 152, which may be discriminator means of a well-known type or any other desired frequency-deviation-responsive means which will sense any apparent deviation in the received frequency from a predetermined normal transmitted frequency emitted by the transmitter means carried by the second vehicle and radiating said warning signal which is of a particular predetermined normal frequency.

The frequency-responsive means indicated at 152 in FIG. 4 has two output terminals, as indicated at 154 and 156, which are adapted to have a corresponding output signal produced at one or the other of same depending upon which direction of frequency deviation from the predetermined transmitted norm is sensed by the frequency-responsive means 152. For example, in the form illustrated, the terminal 154 will be effectively provided with an output signal if the frequency deviation sensed by the frequency-responsive means 152 is a deviation in a frequency-increasing, or higher frequency, direction from the frequency of the predetermined normal transmitted warning signal, while, conversely, the terminal 156 will be effectively provided with an output signal if the sensed frequency deviation from the normal transmitted warning signal is in a frequency-reducing, or lower frequency, direction. The upper frequency deviation output terminal 154 is connected to a perceptible indicator which may be a colored lamp positioned on the dashboard or instrument panel of the motor vehicle, or in some other convenient perceptible location, or it may be means for producing a distinctive warning tone, such as a bell, buzzer, or the like, and a similar perceptible warning device such as a lamp or a sound producer similarly located as indicated at 160, may be coupled to the lower frequency deviation output terminal 156. If the two frequency deviation indicators 158 and 160 are warning lamps or the like, they may be of two different colors or may be located adjacent to legends on the dashboard or instrument panel indicating "approaching" in the case of 158 and indicating "receding" in the case of 160, or any other suitable arrangement may be employed which will clearly indicate to an occupant of the first motor vehicle that the second motor vehicle is either approaching (corresponding to activation of the indicator 158) or is receding (corresponding to activation of the other indicator 160). Thus, an occupant of the first motor vehicle will know whether or not the emergency vehicle is approaching his vehicle or is receding from it and can thus take evasive action or safety action only in the event that the approaching movement indicator 158 is activated. Incidentally, in this particular form of the invention, it should be noted that the tuner 58 is either tuned broadly enough to allow the main signal to pass therethrough to the remaining portions of the receiving apparatus, irrespective of such small-scale frequency deviation as that sensed by the frequency-responsive means 152 briefly described above or, if desired, the frequency-responsive means 152 may be connected to the radio frequency receiving means 22 ahead of the tuner 58 in certain forms of the invention, if desired. All such arrangements are intended to be included and comprehended herein. Otherwise, this modification of the invention is generally similar in structure, function, and operation to previously described forms of the invention and no further detailed description thereof is thought necessary since it is believed that it would be redundant for the reasons noted above.

Figure 5:
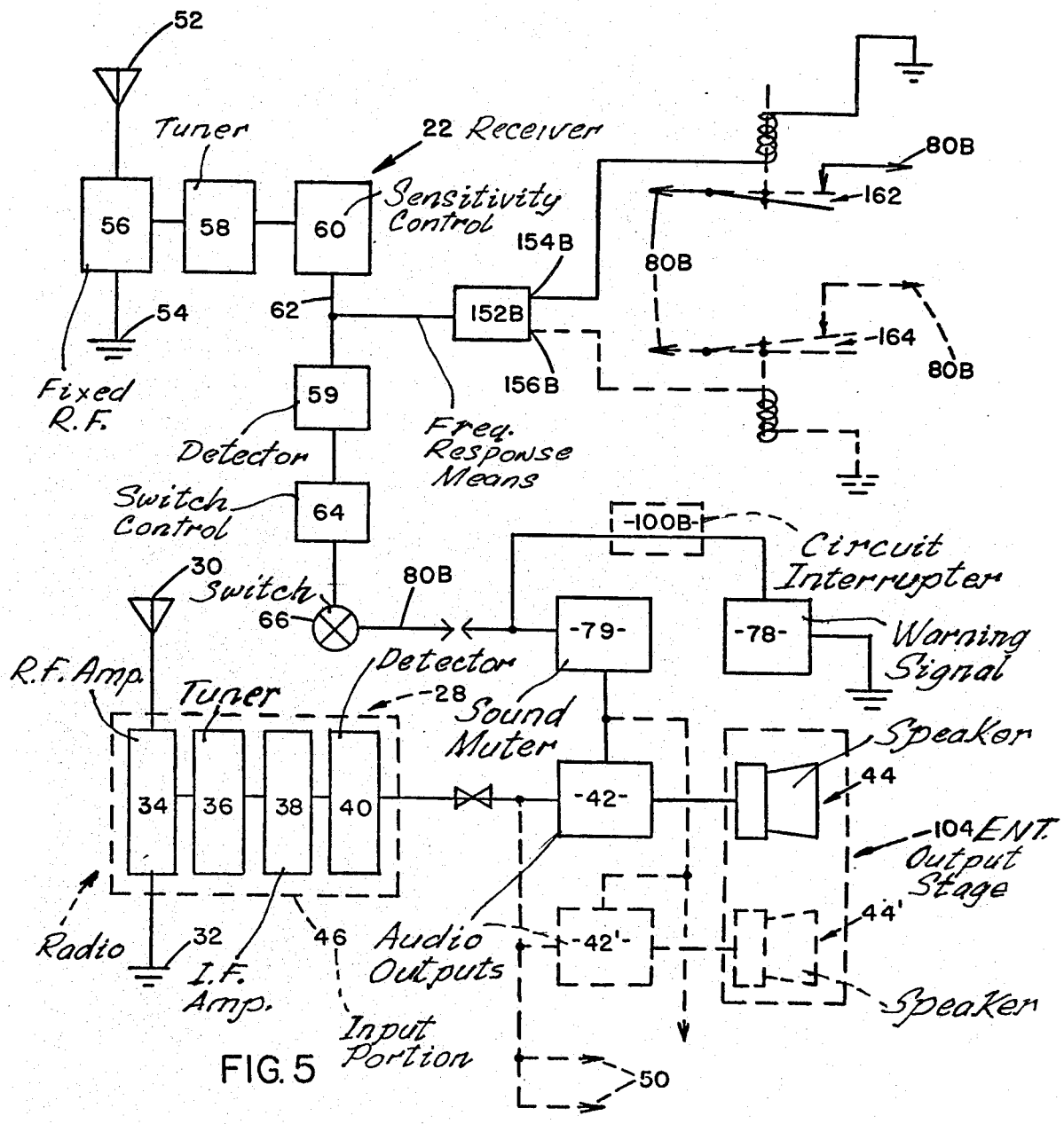
FIG. 5 is a fragmentary view similar to a portion of FIG. 4, but illustrates a slight variation thereof wherein the frequency-deviation responsive means operates activation means only when the sensed frequency deviation is in a frequency-increasing direction relative to the predetermined normal transmitted radio frequency (and, thus, corresponds to the condition when the emergency motor vehicle is approaching the first motor vehicle) for causing the remainder of the warning-signal-producing means to be activated; and, conversely, operates to effectively inactivate the entire perceptible warning-signal-producing means carried by the first motor vehicle whenever the emergency motor vehicle is receding from the first motor vehicle even if it is within a predetermined and normally activating distance from the first motor vehicle.

FIG. 5 is a fragmentary view similar in many respects to FIG. 4, but illustrates a very slight variation thereof wherein parts of the apparatus which are similar to those previously illustrated in FIGS. 2 and 2A are designated by the same reference numerals as employed in FIGS. 2 and 2A for identifying same, but wherein the frequency-responsive means of FIG. 4 is slightly modified from the showing of FIG. 4 and, therefore, parts of said frequency-responsive means corresponding to those of FIG. 4 are designated by similar reference numerals, followed by the letter "b", however. In this modification, it will be noted that said frequency-responsive means **152*b* only needs to employ one or the other of the two frequency deviation output terminals 154*b* and 156*b* for operating corresponding activation and inactivation means as indicated at 162 and 164, respectively, and which are arranged with respect to the output lead 80*b* connected between the switching means 66 and the perceptible warning-signal-producing means 78 and entertainment sound output muting means 79. It should be clearly noted that it is only necessary to use the frequency deviation output terminal 154*b* and activation means 162 or to alternatively use the other frequency deviation output terminal 156*b* and the inactivation means 164. In either case, the arrangement is such that even when the proximity of the second vehicle to the first vehicle is such that the sensitivity control or gate means 60 would normally cause operation of the perceptible warning-signal-producing means 78 and the entertainment sound output muting means 79 to occur, this will not occur if the second vehicle is receding from the first vehicle, which will of course cause an output signal to appear at the frequency deviation terminal 156*b*, but will not cause any signal to appear at the other frequency deviation terminal 154*b*. Conversely, whenever the second vehicle is approaching the first vehicle, there will be no output signal at the frequency deviation terminal 156*b*, but there will be an output signal at the other frequency deviation terminal 154*b* and, thus, in the first-mentioned case the inactivation switch means 164 (which is normally closed) will be effectively opened to prevent operation of the subsequent elements 78 and 79 and, in the other case, the presence of the signal at the terminal 154*b* will cause the closure of the activation switch 162 (which is normally open) so as to positively place the elements 78 and 79 in condition for operation. It should be clearly understood that only one or the other of the two relay controlled switches 162 and 164 is needed and that the only reason that both are shown in FIG. 5 is to make it clear that either type of arrangement may be employed. The balance of the apparatus of FIG. 5** is essentially the same structurally, functionally, and operationally as previously described forms and, therefore, no further description is thought necessary in view of its obvious redundancy.

Figure 6:
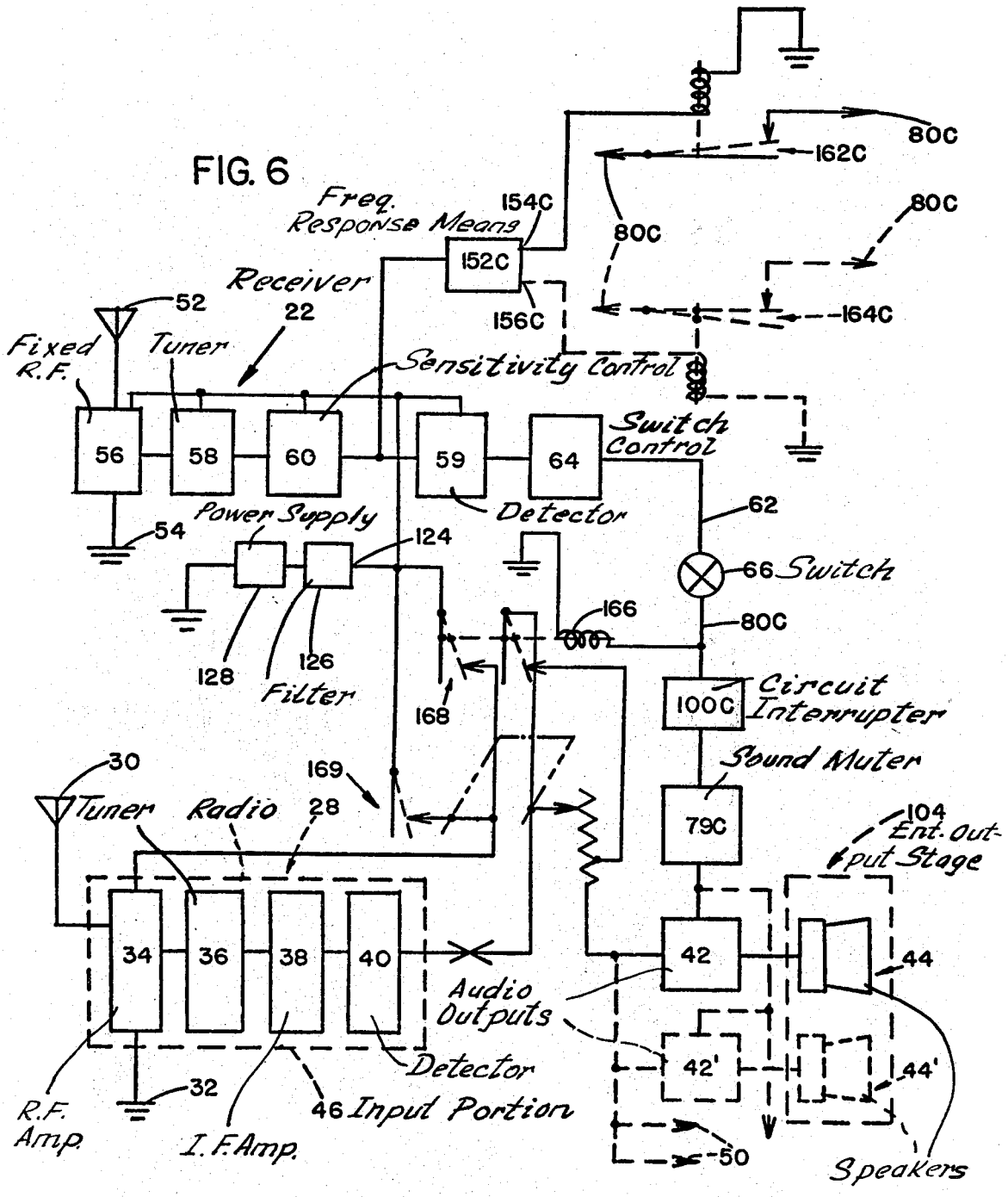
FIG. 6 is a fragmentary view generally similar to an output portion of FIG. 2 and merely illustrates several different alternate kinds of perceptible warning-signal-producing means adapted to be carried within the first motor vehicle and to be operated in response to a received radio frequency warning signal emitted by a nearly approaching emergency vehicle.

FIG. 6 is a fragmentary view similar to a portion of FIG. 5, with the only difference being that the warning-signal-producing means 78 of FIG. 5 is essentially eliminated as a separate entity in the FIG. 6 modification and, instead, the lead **80*c* from either the activation switch means 162*c* connected to the frequency deviation terminal 154*c* or from the inactivation switch means 164*c* connected to the other frequency deviation terminal 156*c* is fed through a circuit interrupter 100*c* of substantially the same type as the optional circuit interrupter 100 of FIG. 2A (but which may be of a slower frequency type) which is fed into a slightly modified but generally similar entertainment sound output muting means 79 so that the audio output therefrom will be intermittently interrupted at a frequency rate determined by the rate of the circuit interrupter 100*c* whenever the signal from the switching means 66** is present because of the receipt of a warning signal indicating the presence of the second vehicle within a predetermined distance of the first vehicle and when it is approaching rather than receding with respect to the first vehicle.

In the event that the pre-existing entertainment apparatus carried by the first motor vehicle should happen to not be turned on at a time when a perceptible warning signal is received and passed through the warning signal receiving means 22 of the FIG. 6 form of the invention (in which case, it would not intermittently interrupt sound output from the audio output portion of the pre-existing entertainment equipment carried by the first motor vehicle), the lead **80*c* may also energize a relay coil 166 which will close a normally open relay switch 168 which shunts or by-passes the main control switch 169 for the entertainment apparatus 28** so that it will be turned on whereby the output thereof can be intermittently interrupted to comprise the above-described type of warning signal based upon intermittent interruption of the audio output of the pre-existing entertainment equipment carried by the first motor vehicle. If by chance there should be no actual sound being produced by the audio output of the pre-existing entertainment equipment, the intermittent interruption thereof produced by the intermittently interrupted entertainment sound output muting means will produce an intermittent loud popping noise which will also function as a warning signal.

Figure 7:
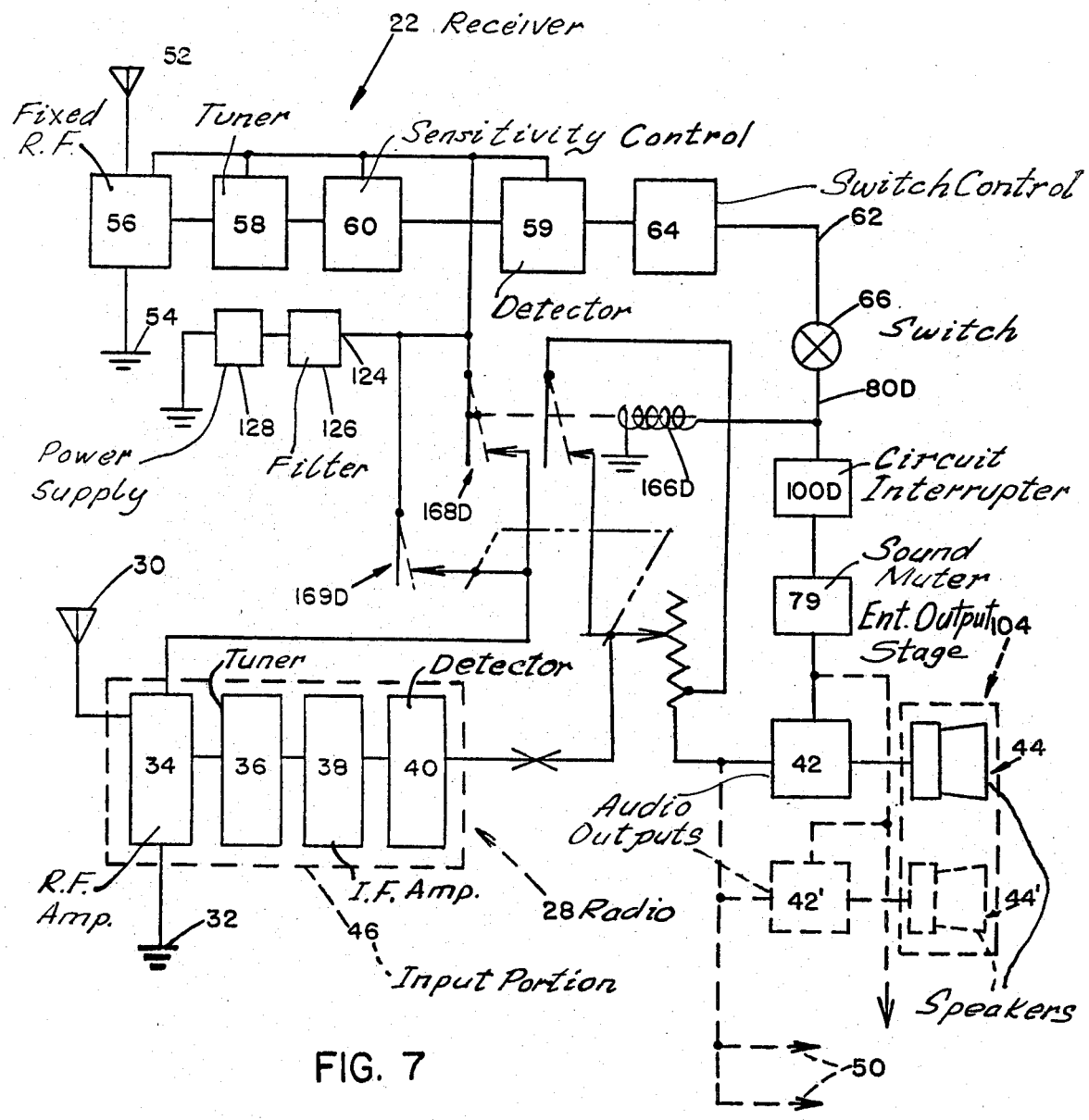
FIG. 7 is a fragmentary view similar to a portion of FIG. 2, but illustrates another slightly varied form of perceptible warning-signal-producing means adapted to be carried within the first motor vehicle and to be activated in response to the receipt by the radio frequency receiver of a radio frequency warning signal transmitted from the nearby approaching emergency vehicle. The perceptible warning-signal-producing means in this case comprises an intermittent interrupter coupled to the audio stage, and/or output electro-acoustic transducer means, of pre-existing entertainment equipment carried within the first motor vehicle and adapted to be activated as a result of receipt by the radio frequency receiver of a radio frequency warning signal transmitted from a nearly approaching emergency vehicle.

FIG. 7 illustrates a very slight modification of the original form of the invention of FIGS. 2 and 2A incorporating, however, the circuit interrupter of FIG. 6, in lieu of a separate perceptible warning-signal-producing apparatus, which is coupled to the entertainment sound output muting means for causing the intermittent operation of same (usually at a relatively slow rate) so as to cause the regular interruption of output sound from the entertainment apparatus carried by the first motor vehicle. Because it does comprise a slight modification, parts thereof which are similar to corresponding parts of previously described forms of the invention are designated by the same reference numerals. However, modified parts are designated by similar reference numerals, followed by the letter "d", however, and new parts are designated by new reference numerals.

In this modification, it will be noted that the perceptible warning-signal-producing means, such as shown at 78 in earlier forms of the invention, is effectively eliminated as an independent or separate structure and, instead, the intermittent circuit interrupter **100*d* is placed directly in the lead 80***d* which causes intermittent interruption of the operation of the entertainment sound output muting means, indicated generally at 79, so that it will intermittently mute the entertainment equipment output portion, indicated at 104, of pre-existing entertainment equipment 28 carried by the first motor vehicle and, thus, will produce the same type of entertainment equipment interrupted-sound-output effectively comprising the perceptible warning signal means as has been previously described as characteristic of the FIG. 6 form of the invention. Also, this modification may, if desired, be provided with an additional entertainment equipment starting relay coil 166*d* and starting relay switch 168*d* which is normally open and which is adapted to be connected so as to by-pass or shunt the normal entertainment equipment starting switch 169*d* so as to cause it to be energized if it should happen to be off whenever a warning signal is received by the receiving means 22 and passed through the apparatus to the switching means 66. This operates in essentially the same manner as does the previously described modification illustrated in FIG. 6. Otherwise, the FIG. 7 modification is similar to the first form of the invention, as best shown in FIGS. 2 and 2A, and it is believed that no further description thereof is necessary in view of its obvious redundancy.

Figure 8:
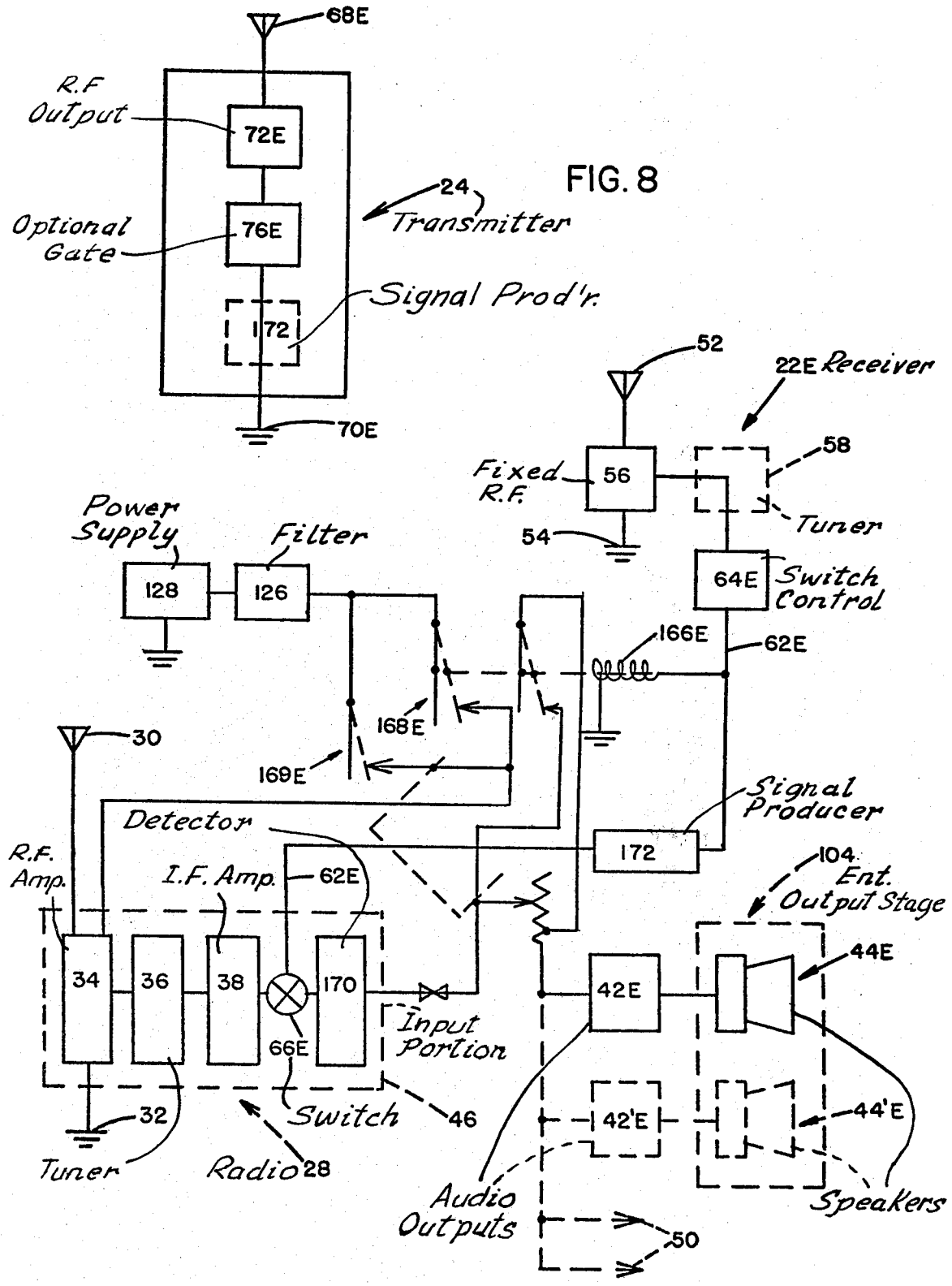
FIG. 8 is a fragmentary view similar to a portion of FIG. 2, but illustrates a slighty varied form of the receiving portion of the apparatus adapted to be carried by the so-called first motor vehicle and, in this case, showing the output of the radio frequency receiver coupled to a portion of the pre-existing entertainment apparatus (in the example illustrated, comprising a radio) carried by the first motor vehicle at a location ahead of the detector. This is so that no separate detector is required. In this case either the radio-frequency transmitter carried by the emergency vehicle or the radio-frequency receiver carried within the first vehicle is provided with interrupter means or other means for effectively converting the received and detected signal into one which will produce a corresponding perceptible output signal in the audio output stage, and subsequent electro-acoustic transducer means of the pre-existing radio (or other entertainment apparatus) initially carried by the first vehicle.

FIG. 8 illustrates a form of the invention very similar to the first form illustrated in FIGS. 2 and 2A and, therefore, corresponding portions are designated by corresponding reference numerals, and modified portions are designated by similar reference numerals, followed by the letter "e", however. It will be noted that in the FIG. 8 modification the receiving means 22*e* does not have its own detector stage such as that shown at 59 in the first form of the invention, but instead is so connected with respect to the pre-existing entertainment equipment 28 as to employ the detector stage 170 of the pre-existing entertainment equipment which, thus, eliminates the entertainment sound output muting means, such as shown at 79 in the first form of the invention, and a separate warning-signal-producing means, such as shown at 78 in the first form of the invention, and instead the output lead 62*e* of the receiving means 22*e* is provided with a signal producer, indicated in block diagrammatic form at 172, which may comprise any type of modulator or it may comprise a circuit interrupter similar to that shown at 100 in the first form of the invention so that the switching means control means 64*e* will be intermittently interrupted and the signal fed through the detector stage 170 and the subsequent audio stage and electroacoustic transducer means output stage 42*e* and 44*e* will provide a high-volume, very clearly identifiably modified or interrupted signal effectively superimposed upon the audio signal from the entertainment equipment 28 so that it will be clearly perceptibly produced by the electro-acoustic transducer means 44*e* and thus will be clearly perceptible to an occupant of the first motor vehicle.

In the event that the pre-existing entertainment equipment 28 might be de-energized at the time that a warning signal is received by the receiving means 22*e*, a shuntmounted starting switch 168*e* and control relay coil 166*e* energized by the control lead 62*e* may be provided in a manner similar to the corresponding showings of corresponding apparatus in the FIGS. 6 and 7 forms of the invention for the purpose of effectively turning on the entertainment equipment 28 whenever such a warning signal is received by the receiving means 22*e*.

As an alternate to the provision of the special warning signal modulator or circuit interrupter 172 in the lead 62*e*, it may optionally be positioned in coupled relationship with respect to the radio frequency transmitter 24 carried by the second vehicle so that the signal interruption and modulation will already be present in the transmitted signal and, thus, the corresponding element 172 would not be required in the lead 62*e* of the receiving means 22*e*. This is merely an optional alternate shown in broken lines in FIG. 8.

Otherwise, this modification is similar in structure and function to previously-described forms of the invention and it is believed that no further detailed description thereof is necessary in view of its obvious redundancy.

Figure 9:
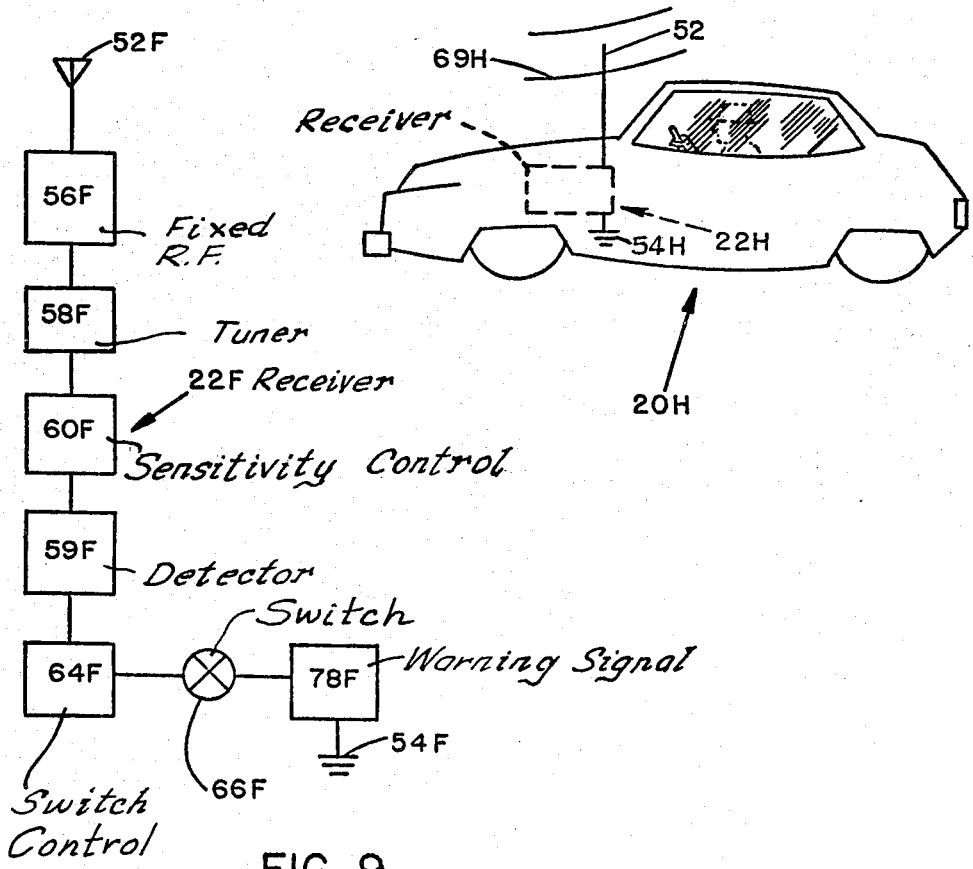
FIG. 9 is a fragmentary, diagrammatic, simplified view similar in many respects to FIG. 2, but illustrates a modified form of the apparatus wherein the first motor vehicle is not initially provided with a pre-existing radio or other entertainment apparatus, and, consequently, the warning signal radio-frequency receiver carried by the first motor vehicle is provided with subsequent stages effectively replacing, and functioning in lieu of, the portion of a conventional pre-existing radio, or other entertainment apparatus, shown as being utilized in FIG. 2, but in the case of FIG. 9 comprising part of the radio-frequency-warning-signal-receiving means and means for converting same into a perceptible warning signal within the first motor vehicle.

FIG. 9 is a view illustrating a modification wherein the first motor vehicle is not provided with any preexisting radio, or other entertainment apparatus, to be muted and, therefore, the receiving means must be complete in itself since it does not cooperate with any portion of a pre-existing entertainment apparatus. Because this view does illustrate a modification, parts which are structurally or functionally equivalent to corresponding parts of previously described forms of the invention are designated by similar reference numerals, followed by the letter "f", however. In this modification, it will be noted that the receiving means 22*f* is substantially similar to the form of the invention illustrated in FIGS. 2 and 2A through the switching means control means 64*f*, and the switching means 66*f* controlled thereby. However, the switching means 66*f* controls only the perceptible warning-signal-producing means 78*f* and does not control entertainment output sound muting means, such as shown at 79 in the form of the invention illustrated in FIGS. 2 and 2A. This is so because in this modification there is no pre-existing entertainment apparatus having an audio output and an electroacoustic transducer stage similar to those shown at 42 and 44 in the form of the invention illustrated in FIGS. 2 and 2A to be muted during reception of a warning signal. All that is required is the operation of the perceptible warning-signal-producing means.

It should be noted that while the FIG. 9 modification is illustrated and has just been briefly described in a manner related to the earlier form of the invention illustrated in FIGS. 2 and 2A, it is not specifically limited thereto but may be provided with frequency-responsive means such as illustrated at 152 in FIG. 4, for example, or at 152*b* in FIG. 5, or 152*c* in FIG. 6, whereby to cause the perceptible warning-signal-producing means 78*f* of FIG. 9 to be rendered operative only when the second vehicle is approaching the first vehicle and is within a predetermined distance thereof or, alternatively, to provide a perceptible indication of whether or not the second vehicle is approaching or receding with respect to the first vehicle, in the manner of FIG. 4. Any or all of these modifications may be effectively combined with the FIG. 9 form of the invention where the receiving means must be complete and self-contained and does not cooperate with any pre-existing entertainment equipment apparatus. It is believed that no further description is necessary in view of the obvious redundancy thereof based upon the full and complete description of corresponding portions of previously described forms of the invention set forth in detail hereinbefore.

Figure 10:
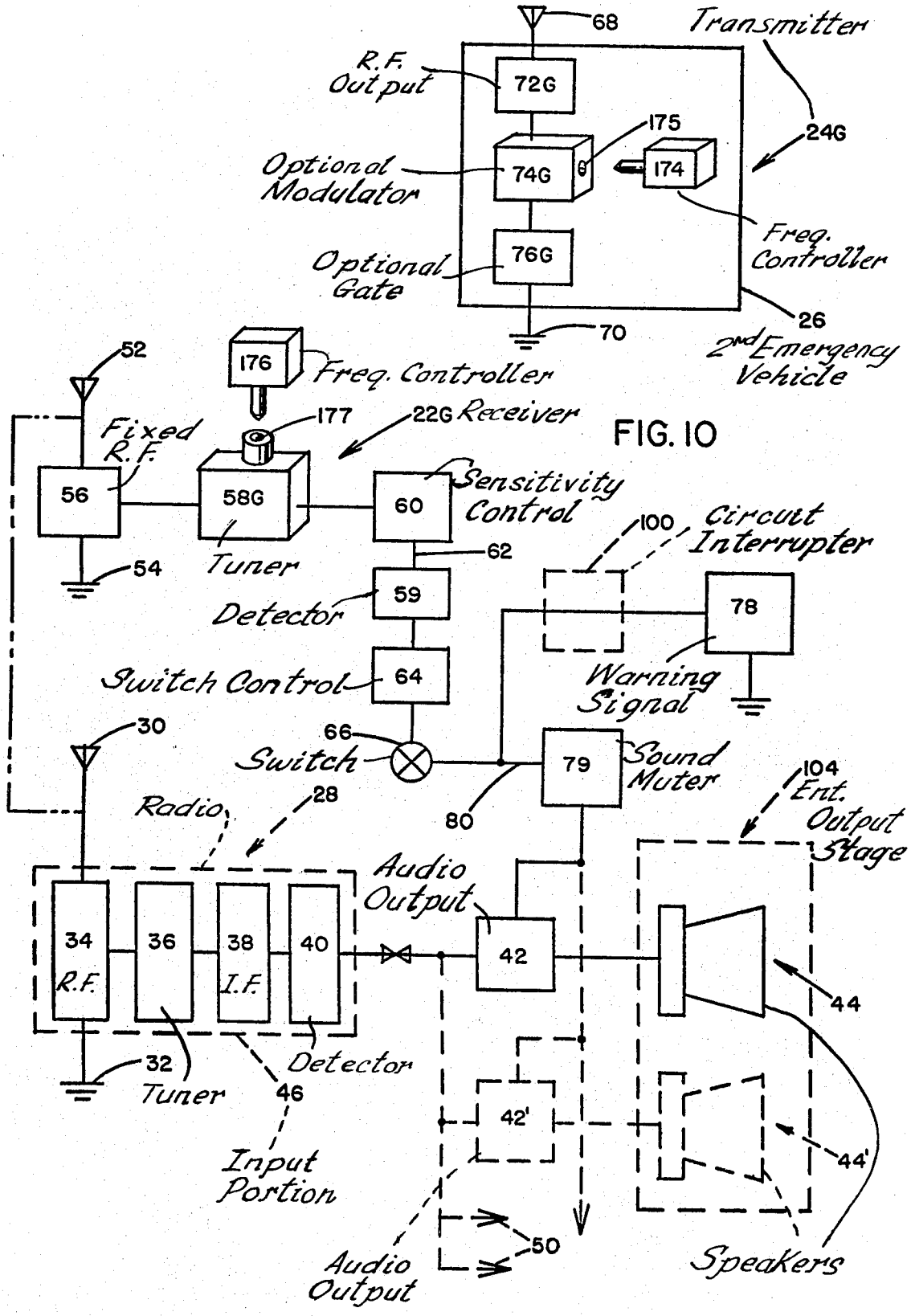
FIG. 10 is a fragmentary view, similar to a portion of FIG. 2, but illustrates a conventional frequency-controlling arrangement for not only selecting an appropriate predetermined radio frequency for transmission and reception by the corresponding transmitting and receiving portions of the apparatus, but for precisely controlling said radio frequency, as made necessary by location and frequency-availability in any given area. In this modification, the frequency-adjusting and frequency-controlling function for both the radio-frequency transmitter and radio-frequency receiver is, in each case, provided by a corresponding modular plug-in frequency-controlling unit, shown generally in block diagrammatic form in FIG. 10, which may comprise a crystal-controlled frequency-determining unit of a conventional well-known type, or any substantial functional equivalent which will provide the desired precise frequency control, matched in both the transmitter and the receiver, and lying within the predetermined, selected desired frequency range (band width).

FIG. 10 is a fragmentary view similar to portions of FIGS. 2 and 2A with similar portions being designated by similar reference numerals, followed by the letter "g", however. In this modification, the major change from the earlier form illustrated in FIGS. 2 and 2A is the provision of a modular or plug-in frequency-controlling unit, indicated generally at 174, adapted to be readily plugged into a pre-existing receiving plug-in aperture 175 in the transmitter **24*g* for very precisely controlling the transmitted frequency, and the further provision of a modular plug-in frequency-selecting and frequency-passing effective through-passing filter means, indicated diagrammatically at 176, adapted to be easily plugged into a corresponding receiving recess 177 in the radio frequency receiving means 22*g* for very precisely controlling the received and through-passed frequency allowed to pass from the input side thereof to the output side thereof and adapted to match the transmitted frequency selected and precisely controlled by the frequency-controlling unit 174 similarly plugged into the transmitter 24*g***.

The frequency-controlling plug-in unit 174 may be a conventional frequency-controlling means of any well-known type, such as a crystal-controlled oscillator, or the like, (although not specifically so limited) and may be employed as the frequency-controlling element of the means for producing the transmitted frequency, or it may be employed in a conventional effective frequency-passing or frequency-rejecting filter construction arranged to filter out and effectively reject all unwanted frequencies produced by some other frequency-generating means associated with the transmitter **24*g*** and only permitting the passage therethrough of a precisely determined frequency band for transmission as the warning signal. Detailed construction of such a frequency-controlling unit is well-known in the art and, therefore, is not shown in full electrical schematic detail and, further, since such detail does not touch upon the real inventive concept of the present invention.

The plug-in modular frequency-selecting unit 176 adapted to be plugged into the receiving means **22*g* and adapted to match the controlled transmitted frequency provided by the plug-in modular frequency-controlling unit 174 carried by the transmitter 24*g*, may be of the same general type of construction as the above-described form of said frequency-controlling unit 176—that is, it may comprise a frequency-passing and frequency-rejecting filter means which will pass therethrough a selected frequency, or a selected narrow band of frequencies, while substantially rejecting all other frequencies, and this may be provided in a number of different well-known types of construction, some of which embody crystal control elements or other very precise frequency-determining elements of a piezo-electric type or any conventional electrostrictive or magnetostrictive type, or any functional equivalent type thereof, which will thus provide a very sharply defined frequency-selective and frequency-through-passing characteristic for the modular plug-in unit 174**.

The purpose of the two matching co-ordinated modular plug-in units 174 and 176 is to make it possible to select different warning signal transmission frequencies for different conditions and different arrangements of use as dictated by the available open and otherwise unused frequencies in any particular area. Furthermore, different warning frequencies can be selected wherever it is thought that interference might exist. The construction shown in FIG. 10 makes this extremely simple to do by merely selecting a pair of matched frequency units 174 and 176 which correspond to a desired transmission frequency and plugging them into the corresponding receptacles in the transmitter **24*g* and the receiver 22*g*. If it is desired to change the warning signal frequency at any time, this can be easily done by merely changing the corresponding modular frequency units 174 and 176. Otherwise, the modification of FIG. 10** is essentially the same as previously described forms and it is believed that no further detailed description thereof is necessary in view of the obvious redundancy thereof.

Figure 11:
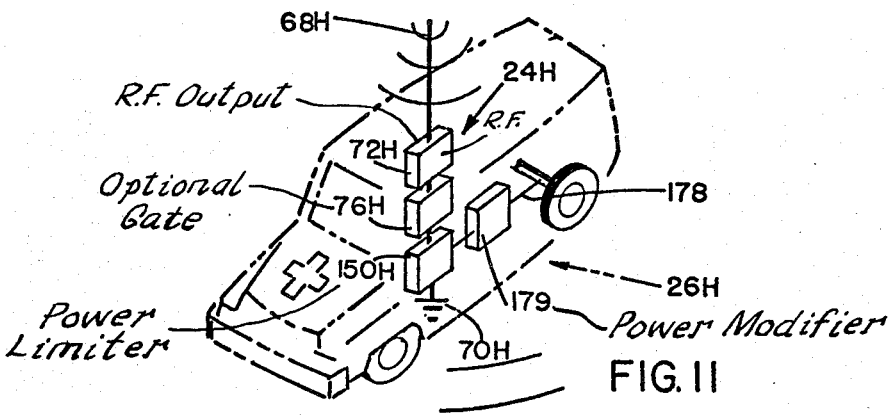
FIG. 11 is a fragmentary view, generally similar in many respects to FIG. 3, but illustrates a modification wherein the radio-frequency transmitter carried by the second vehicle is provided with output-power-modifying means effectively controlled by the speed of travel of the second motor vehicle so that at a predetermined minimum or normal speed, the output power produced by the radio-frequency transmitter will be of a certain level which will be correspondingly increased as the speed of travel of said second motor vehicle increases relative to the normal initial value thereof, thus causing a higher power signal to be transmitted (approximately twice the normal power) when the second motor vehicle is travelling at approximately 70 miles per hour as compared to when it is travelling at approximately 35 miles per hour, whereby to cause the radio frequency receiver, tuner, and gate or limiter means carried by the first motor vehicle to be effectively activated when approximately twice the separation exists between the first and the second motor vehicles when the second vehicle is travelling at 70 miles per hour than would be the case when it is travelling at said 35 miles per hour. The purpose of this is to provide approximately the same warning time period between the reception of an activating warning signal by the radio frequency receiver of the first motor vehicle and the subsequent time when the rapidly approaching second motor vehicle will be virtually immediately adjacent to the first motor vehicle so that said substantially equal warning time period will virtually always be available for use by the driver of the first motor vehicle in taking the proper evasive action.

FIG. 11 is a view generally similar to FIG. 3, but illustrates a slight modification thereof and, consequently, corresponding parts are designated by similar reference numerals, followed by the letter "h", however, The major difference of the FIG. 11 modification from the showing of FIG. 3 is the provision in the radio frequency transmitter 24h of an output-power-modifying means, indicated generally at 179, which effectively cooperates with or modifies the power limiter **150*h* corresponding to the power limiter 150 shown in FIG. 3, but, in this case, taken in conjunction with the output-power-modifying means 179, acting to provide variable radiated output power produced by and radiated from the transmitting means 24*h* in correspondence with the speed of travel of the second motor vehicle 26*h*. This is indicated somewhat diagrammatically by a coupling line 178 indicating the coupling of the output-power-modifying means 179 to some driven portion of the motor vehicle 26*h* which moves in correspondence with the speed of travel thereof. The moving portion of the motor vehicle 26*h* to which the coupling lead 178 is effectively coupled may comprise the drive shaft, any of the wheels of the vehicle, any portion of the engine, the speedometer cable, or any other portion which will cause a modification of the output power produced by and radiated from the transmitter 24*h* as a direct function of the speed of travel of the second motor vehicle 26*h*. Thus, when the motor vehicle 26*h* is travelling at a greater-than-average speed, the radiated power transmitted from the transmitter will be correspondingly greater and, thus, will be received and effectively passed by the gate means of the receiving means 22*h* when the spacing between the transmitting second vehicle 26*h* and the receiving first vehicle 20*h* is correspondingly greater. This will of course provide a warning signal to an occupant of the first motor vehicle 20*h*** of substantially the same time-duration before the rapidly moving second vehicle reaches the immediate vicinity of the first vehicle virtually irrespective of the speed of travel of the second vehicle as it approaches the first vehicle and, thus, will allow substantially the same period of time for the driver of the first vehicle to take the proper protective, safety, or evasive action in order to avoid any possibility of a collision occurring between the rapidly approaching second vehicle and the first vehicle.

It should be noted that the modification of FIG. 11 may also be incorporated in the variation of the FIG. 2 and FIG. 2A form of the invention illustrated in FIGS. 4, 5, 6, or 7, whereby to also provide information as to whether or not the second vehicle is actually approaching the first vehicle or is receding therefrom and, in the later modifications thereof, for also using the approaching movement information and/or receding movement information for controlling the activation of the perceptible warning-signal-producing means and the entertainment sound output muting means so that there will be no action from an otherwise activating signal received from a nearby second vehicle if it is receding from the first vehicle rather than approaching same and otherwise meets the activation conditions previously described. All such combinations of various different forms of the invention are intended to be included and comprehended herein as fully as if individually illustrated and individually fully described with respect to each such permutation and combination of various subportion modifications of the over-all present invention.

The specification and the drawings have been separately and independently finalized (finally typed in the case of the specification and finally inked and shaded in the case of the drawings), which has resulted in a rather unusual type of correlation between part numbers as finally typed in the specification and as finally inked on the drawings, although the correspondence thereof is definite and positive. The unusual type of part number correspondence, as shown in the drawings and the specification, comprises the fact that the letter portions of the part numbers, as finally typed in the specification, are largely lower-case letters while exactly the same letter portions of the same part number designations, as shown in finally inked form on the drawings, are largely uppercase letters. While this is not customary, it does not provide any difficulty in correlating the various parts of the invention, as described in the specification, with the same parts of the invention, as illustrated in the figures of the drawings, and, therefore, no modification of either the upper-case letters of the drawings or the lower-case letters of the specification is thought necessary. If the Examiner or the Chief Draftsman believes that there should be such a modification, it appears that it would be simpler to merely modify all part numbers in the specification by changing the lower-case letter portions thereof to the same letter in upper case or capital form.

It should be noted that the intended inclusion in all motor vehicles of the motor-vehicle-presence-indicating receiving means, such as indicated at 22 in the first form of the invention and correspondingly indicated in various other forms of the invention by either the same reference numeral or the same reference numeral followed by different lower-case letters to indicate different, slightly variant forms of the invention, makes the apparatus highly suitable for providing a motorist with any important public service or emergency information emanating from a plurality of emergency vehicles or from a central transmitter location such as, for example, from a Director of Civil Defense Office or a National Emergency Office, or the like. Thus, in the event of a national emergency, such as an attack from an enemy, a natural catastrophe such as an earthquake, a tidal wave, or other catastrophic event, a warning message could be broadcast on the emergency warning signal frequency normally employed by the transmitter of each emergency vehicle and to which the receiving means of all of the motor vehicles are tuned. This would make it possible to reach virtually the entire motoring public immediately with any such important emergency message and might even facilitate the reaching of motor vehicle occupants who otherwise would not be able to receive the national emergency message because of being located in a region where radio reception is extremely poor, such as in a deep canyon, or the like, or in some shielded area. In this latter situation, if the national emergency message is relayed out to the transmitters of all of the emergency vehicles deployed throughout various locations in a region of substantial area, it will normally be likely that at least one emergency vehicle will be located effectively near to such a receiving motor vehicle located in a region where radio reception from a relatively remote transmitter is somewhat difficult so that the receiver of said vehicle will probably receive at least the message broadcast from that particular emergency vehicle located nearby. This will greatly enhance the over-all effectiveness of such a national emergency warning message, and means may be employed for coupling same directly to the audio output portion of the apparatus in the receiving motor vehicle, or the perceptible warning signal may be employed to alert the motorist to a simultaneously broadcast national emergency message received over the regular radio channel (or, perhaps, all stations) and audibly reproduced within the vehicle by the electro-acoustic transducer means of the entertainment apparatus or radio contained therein. It should be clearly understood that all forms of the invention are readily adaptable to this national emergency broadcast or warning purpose and usage and that the direct use of the apparatus or the use of the apparatus with additional slight modifications or additions thereto for facilitating such national emergency warning purpose usage are all intended to be included within the broad scope of the invention.

It should be understood that the figures and the specific description thereof set forth in this application are for the purpose of illustrating the present invention and are not to construed as limiting the present invention to the precise and detailed specific structure shown in the figures and specifically described hereinbefore. Rather, the real invention is intended to include substantially equivalent constructions embodying the basic teachings and inventive concept of the present invention.

What is claimed is:

1. Warning-signal-producing apparatus for a motor vehicle responsive to a vehicle-presence-indicating radio-frequency signal emitted by a second vehicle and indicative of its presence, comprising: a vehicle-presence-indicating radio-frequency-signal-receiving means adapted to be carried by a first motor vehicle and provided with tuning means effectively tuning same so as to receive a vehicle-presence-indicating radio-frequency-transmitted signal adapted to be transmitted by and from the second vehicle, said vehicle-presence-indicating radio-frequency-signal-receiving means effectively including, a first vehicle warning signal input means adapted to produce a first vehicle input warning signal from said radio-frequency-signal-receiving means in response to receipt of a vehicle-presence-indicating radio-frequency-transmitted signal emanating from such a second vehicle; perceptible warning-signal-producing means adapted to be carried by such a first motor vehicle and switching means controlling the activation and inactivation thereof; and first vehicle input-warning-signal-responsive switching means control means responsive to receipt of said signal from said warning-signal input means for correspondingly activating and inactivating said switching means for correspondingly controlling the activation and inactivation of said perceptible warning-signal-producing means; said switching means being effectively coupled to and controlled by said input-warning-signal-responsive switching means control means in a manner causing the operation of said switching means and the activation of said perceptible warning-signal-producing-means only when a predetermined type of vehicle-presence-indicating radio-frequency-transmitted signal has been received by said radio-frequency-signal-receiving means adapted to be carried by such a first vehicle; said radio-frequency-signal-receiving means, said tuning means thereof, and said effectively included first vehicle warning signal input means being together effectively provided with controllably adjustable and precisely distance-calibrated limiter and effective gate means, with said first vehicle warning signal input means being effectively operable by reason of said controllably adjustable precisely distance-calibrated limiter and gate means, to cause said effective coupling of said first vehicle warning signal input means to said switching means and the consequent operation of said switching means to cause said activation of said perceptible warning-signal-producing means by operating the effectively positively reject all signals below a predetermined and fully controllably adjustable and precisely distance-calibrated magnitude and to positively pass all signals in excess of said controllably adjustable and precisely distance-calibrated magnitude corresponding to the reception of said vehicle-presence-indicating radio-frequency transmitted signal emanating from such a second vehicle which is physically spaced from such a first vehicle by a distance within, or less than, a precisely predetermined maximum distance; and a radio-frequency-signal-transmitting means and tuner means therefor, tuning the output thereof to a precisely desired type of radio-frequency-transmitted signal, said transmitting means being adapted to be carried by a second vehicle for vehicle-presence-indicating purposes with respect to such a first vehicle, said radio-frequency-signal-transmitting means being further provided with controllably adjustable and precisely distance-calibrated transmitted signal power-controlling-and-limiting means for controllably adjustably and distance-calibratably limiting the output power of the emitted radio-frequency transmitted signal to a precisely distance-calibrated predetermined maximum radiated power corresponding to a precisely predetermined distance from said radio-frequency-signal-receiving means adapted to be carried by such a first vehicle whereby, together with said limiter and gate means of said first vehicle warning signal input means to effectively comprise precisely adjustable and precisely distance-calibrated range control and determining means such as to only activate said perceptible warning-signal-producing means adapted to be carried by such a first vehicle when such a transmitting second vehicle is within a precisely calibratably predetermined distance from such a first vehicle; said radio-frequency-signal-receiving means, and said tuner therefor, being effectively provided with frequency-responsive means responsive to apparent received frequency deviations from a predetermined transmitted normal frequency for correspondingly sensing the approaching or receding movement of such a transmitting second vehicle relative to such a receiving first vehicle.

2. Apparatus as defined in claim 1, including means for converting the relative vehicle movement information provided by said frequency-responsive means into information-communicating intelligence perceptible to an occupant of such a first vehicle for providing perceptible information corresponding to the approaching or receding relative movement of such a second vehicle relative to such a first vehicle.

3. Apparatus as defined in claim 1, including means for converting relative vehicle movement information of the vehicle-approaching type, provided by said frequency-responsive means, into an activation signal effectively applied to said switching means for causing the activation of said perceptible warning-signal-producing means and, conversely, responsive to vehicle-receding information, provided by said frequency-responsive means, for causing the effective overriding inactivation of said switching means and consequently the effective overriding inactivation of said perceptible warning-signal-producing means whenever such a second vehicle is relatively receding from such a first vehicle even when they are spaced apart less than a normal activation distance.

4. Apparatus as defined in claim 1, wherein said radio-frequency-signal-transmitting means is provided with transmitted signal-power modifying means for modifying the output power of the emitted radio frequency warning signal from a predetermined normal magnitude thereof corresponding to a normal predetermined activation distance from such a first vehicle to a different magnitude in correspondence with, and as a function of, the closing relative speed of travel of such a second vehicle with respect to such a first vehicle as it approaches such a first vehicle whereby to correspondingly increase said predetermined activation distance between the vehicles at and below which said radio-frequency signal-receiving means, said tuner therefor, and said gate means associated therewith become effectively operable to pass signals above said predetermined magnitude corresponding to the reception of said radio-frequency warning signal from said radio-frequency-signal-transmitting means adapted to be carried by such a second vehicle which is physically spaced from such a first vehicle by said variable distance, which is a direct function of said closing speed of relative travel of such a second vehicle with respect to such a first vehicle as it approaches same.

5. Apparatus as defined in claim 4, wherein said transmitted signal-power modifying means further includes means operating to further modify said output power of said emitter radio frequency warning signal as a direct function of a predetermined minimum distance multiplied by a factor corresponding to the ratio of said closing relative speed of travel of such a second vehicle with respect to such a first vehicle as it approaches such a first vehicle relative to a predetermined normal minimum value thereof, whereby to cause the activation signal to be passed by said controllably adjustable and precisely distance-calibrated limiter and gate means of said radio-frequency-signal-receiving means at a distance greater than the normal activation distance when said closing relative speed of travel is greater than a minimum normal magnitude thereof and, thus, providing a substantially constant warning time interval between reception of a warning signal passed by said radio-frequency-signal-receiving means adapted to be carried by such a first vehicle and the arrival of such a transmitting second vehicle at a point immediately adjacent to such a receiving first vehicle.

* * * * *